US005697168A

United States Patent [19]

Matthys et al.

[11] Patent Number: 5,697,168

[45] Date of Patent: Dec. 16, 1997

[54] INDIRECT HEATING SCREW CONVEYOR

[75] Inventors: Pierre Matthys, Laguna Niguel; Philippe J. Matthys, Costa Mesa; Robert A. Shelden, Cerritos, all of Calif.; Felix G. Marcelino, Mansfield, Tex.; Michael Katko, Riverside, Calif.

[73] Assignee: Separation and Recovery Systems, Inc., Irvine, Calif.

[21] Appl. No.: 286,999

[22] Filed: Aug. 8, 1994

[51] Int. Cl.[6] ..... F26B 11/02

[52] U.S. Cl. ..... 34/137; 34/147; 34/182; 34/241; 110/224; 110/257

[58] Field of Search ..... 34/63, 578, 580, 34/586, 588, 592, 593, 135, 137, 142, 147, 166, 179, 181, 182, 241; 110/224, 227, 229, 257; 198/658, 570

[56] References Cited

U.S. PATENT DOCUMENTS

| | | | |
|---|---|---|---|
| 4,504,222 | 3/1985 | Christian | 34/182 X |
| 4,606,283 | 8/1986 | DesOrmeaux et al. | 110/224 X |
| 5,010,831 | 4/1991 | Halfhide | 110/257 X |
| 5,321,898 | 6/1994 | Robinette, Jr. et al. | 34/182 X |

FOREIGN PATENT DOCUMENTS 2269544 11/1994 United Kingdom .

OTHER PUBLICATIONS

Article entitled "Low–Temperature Thermal Treatment of Contaminated Soils," The Hazardous Waste Consultant, Mar./Apr. 1992, pp. 1.1–1.4.

*Primary Examiner*—Henry A. Bennett
*Assistant Examiner*—Steve Gravini
*Attorney, Agent, or Firm*—Akin, Gump, Strauss, Hauer & Feld, L.L.P.

[57] ABSTRACT

Single or multi-screw indirect-heating screw conveyor desorbers having a heating gas guide enclosed by the screw shaft wall (single-wall screw shafts) or located between a screw shaft wall and an internal chamber wall (double-walled screw shafts). Predetermined amounts of cooling and diluting fluid may be added to a heating gas stream to control the maximum temperature thereof. Screw shaft support bearings and rotary drive components may be cooled, and conveyor wall and/or screw shaft surfaces (e.g.. screw flights and interflight surfaces) may be automatically cleaned during screw shaft rotation by hardened bits and/or breaker devices. Cleaning operations may also involve the interaction of two counter-rotating conveyor screw shafts having mutually interleaved and opposite-handed external flights. Sizing and placement of breaker devices and/or hardened bits is determined empirically to be that necessary to effect substantial removal of material accumulations which would otherwise significantly interfere with efficient conveyor operation. Application of the invention allows design and production of desorbers having decreased weight and size and increased efficiency and reliability compared with currently available indirect-heating screw conveyor desorbers having external screw flights.

35 Claims, 11 Drawing Sheets

INDIRECT HEATING SCREW CONVEYOR

BACKGROUND

1. Field of the Invention

The methods and apparatus of the present invention relate to indirect-heating screw conveyors.

2. Description by Direct and Indirect Heating

Removal of contaminants including volatile organic compounds from semisolid material, including soils, sludges, slurries or other particulate or granular materials, is commonly achieved by methods which include heating the material to desorb (i.e., drive off as gases) relatively volatile components. Gases thus driven off may then be recovered for sale or detoxification by, for example, burning, catalytic action or other chemical processes. An example of this technology is described in U.S. Pat. No. 4,974,528 (Barcell), which relates to a vehicle-mounted system for removing hydrocarbon contaminants from soils. Barcell describes a system in which material transported in a rotary kiln is directly heated by contact with the flame and/or hot exhaust gases from a propane burner assembly. As illustrated in Barcell, direct heating of contaminated material results in a requirement to remove both particulate matter (fines) and certain gaseous contaminants from the burner exhaust stream. These removal operations are complicated by the relatively high temperature and large volume of the exhaust stream and the toxicity of some exhaust gas components.

Indirect heating of contaminated materials, in contrast, keeps both fines and desorbed gas-phase contaminants out of the exhaust stream (if any) of the burner or other heating element. In practice, indirect heating is often accomplished by locating a heat source within the hollow shaft of a screw conveyor having external threads (flights). During screw rotation, heat can flow from the source to the screw shaft surface and thence to material in sliding contact with external portions of that surface, i.e., the flights and screw shaft surfaces between the flights (inter-flight surfaces). Simultaneously, sliding contact with the flights tends to mix the material and transport it in a direction generally parallel to the (longitudinal) axis of screw rotation.

Exhaust gases from such an indirect heating fuel burner may be confined within the hollow shaft, isolated from contact with contaminated material and contaminant vapors. This relatively clean exhaust gas can frequently be directly vented to the atmosphere after exiting the desorber. A separate (closed) recovery system may then be sized to collect only the vaporized portions of contaminated material for further processing. Because burner exhaust gases need not be so processed, any dust collectors, condensers and/or gas scrubbers associated with an indirect heating (closed) system can be smaller than analogous units used with direct-heating desorbers of similar desorbing capacity.

Thus, indirect-heating hollow screw conveyors are preferred for certain medium-temperature (i.e., about 600 to 1200 degrees F.) decontamination apparatus. Electrically heated transportable desorbers which operate in this temperature range are commercially available, but their relatively low heat source output (BTU/hour) limits throughput capacity for contaminated material. Replacement of electrical heaters with fuel burners having substantially higher heat output (e.g., up to about 50 million BTU/hour) would raise both temperature limits and throughput capacity, but high-temperature desorbers have in the past been very large. Significantly reducing the size and weight of high-temperature desorbers would require improvements in several areas.

For example, desorbers comprising relatively lightweight indirect-heating screw conveyors with high-capacity fuel burners frequently experience localized overheating due to nonuniform distribution of transported material, poor heat transfer to the transported material, and/or burner misalignment. Additionally, excessive heat flux to the screw support bearing assemblies and/or rotary drive components (e.g., motors, sprockets, chains and/or gears) may lower desorber reliability by causing premature failure of these components.

Nonuniform heat transfer to transported (contaminated) material is aggravated by suboptimal distribution of heating gas within a screw conveyor screw shaft and by poor mixing of the material and/or refractory deposits of transported material adhering to parts of the screw shaft. Such adherent deposits may reduce heat flux to certain portions of the transported material, reduce material throughput capacity, increase the torque required for screw shaft rotation, and in certain cases even jam the screw shaft. Thus, an improved desorber might address the problem of material accumulations (e.g., by reducing the screw shaft surface maximum temperature) by improving heat distribution to the screw shaft surface and by optimizing the screw shaft temperature gradient for each material desorbed. Removing existing material accumulations on screw shaft and/or conveyor wall surfaces (e.g., by scraping), and cooling beating and drive components and may also be desirable to increase desorption efficiency and reduce material accumulations on desorber (primarily screw shaft) surfaces.

SUMMARY OF THE INVENTION

The methods and apparatus of the present invention relate to high-capacity, temperature-controlled, indirect-heating screw conveyor desorbers and the screw shafts therein. Each desorber has one or more single-wall or double-wall screw shafts for facilitating desorption of volatile and semivolatile fractions from semisolid material in contact with each screw shaft outer surface. Each screw shaft includes one or more substantially helical external flights and a gas guide for optimal distribution of heating gas within the screw shaft. In certain preferred embodiments, provision for active or passive circulation of cooling fluid (preferably comprising air) within screw shaft bearing areas comprising a double-walled cylindrical portion facilitates cooling of the adjacent screw shaft bearing assemblies, rotary drive means and rotary power source(s). Maximum heating gas temperatures may be controlled by dilution of the heating gas with cooling fluid (preferably air). Optional provisions for self-cleaning of screw shaft surfaces (using breaker devices) and conveyor walls (using hardened bits) are also present in certain preferred embodiments of the invention. Application of the invention thus allows design and production of high-capacity desorbers having increased efficiency, reliability and flexibility in comparison with currently available indirect-heating screw conveyor desorbers having one or more screw shafts.

Note that as used herein, a flight comprises a substantially uninterrupted helical surface, a pitch of which is the longitudinal distance measured between successive flight surfaces separated by a single turn around the screw shaft. A flight pitch may thus vary from turn to turn in any (local) portion of the helical surface (i.e., a substantially continuously varying local flight pitch), or the pitch may be a substantially constant value in any local portion of the helical surface with different pitch values in two or more separate local portions (i.e., having at least two discrete local flight pitches). Further, each substantially helical flight may have a single substantially constant local flight pitch throughout, a substantially continuously varying local flight pitch throughout, or a combination of local portions wherein each portion may have either a substantially continuously varying local flight pitch or a substantially constant local flight pitch.

In general, a plurality of (interleaved) flights may be associated with the same longitudinal section of a gas guide or screw shaft outer surface. In such a case, the pitch of any given flight is measured, as described above, between successive surfaces of the given flight (although analogous surfaces of one or more other flights may be interleaved between the surfaces of the given flight which define the pitch measurement). Note that when a screw shaft outer surface or gas guide has more than one flight in a local portion, all of the flights present will have substantially the same local pitch, which may of course change in different local portions. The longitudinal screw shaft length over which at least one external flight extends, regardless of the flight pitch(es), is the effective longitudinal flight length.

Preferred embodiments of screw conveyors according to the present invention employ a counter-current flow pattern, wherein material is carried by external flight surfaces in a direction substantially opposite that of the flow of heating gas in the conveyor (desorber). That is, the conveyed material moves from the second screw shaft end (which is proximate the second screw shaft bearing area) substantially toward the end of the screw shaft through which heating gas is introduced into the screw shaft for distribution in the gas guide (i.e., the first end). This (first) end of each screw shaft is also proximate to the screw shaft wall first end and the first screw shaft bearing area which is coupled thereto.

Screw shafts of the present invention are substantially circular in cross-section and substantially symmetrical about a substantially centered longitudinal rotational axis. The relatively larger diameter screw shaft embodiments are preferably double-walled for at least a portion of their length outside of the screw shaft bearing areas. Screw shaft bearing areas, whether on single-walled or double-walled screw shafts, may themselves be single walled or each may comprise a double-walled cylindrical portion to facilitate cooling. In double-walled screw shafts, a gas guide is coupled between the screw shaft wall and a substantially coaxial internal chamber wall (which together form a double-walled portion of the screw shaft outside of the screw shaft bearing areas).

One end of the central cavity within a double-walled screw shaft (i.e., that cavity enclosed within the internal chamber) may be substantially sealed by a substantially circular and substantially transverse first diverter plate scalingly coupled proximate the first internal chamber end. The first diverter plate may be substantially planar or may (preferably) be substantially conical in at least a central portion for the purpose of smoothly redirecting (diverting) a substantially axial flow of heating gas to a more peripherally located gas guide.

For embodiments of the invention having provision for dilution of the heating gas stream with cooling fluid (to limit its maximum temperature as it enters the gas guide), the cooling fluid may optionally be added to the heating gas stream by injecting the fluid under pressure through one or more perforations in the first diverter plate and thus into the heating gas stream flowing past the plate on its way to the gas guide. Where dilution of the heating gas with a cooling fluid takes place outside of the screw shaft or at a (diluting) burner, cooling fluid injection at the first diverter plate may not be necessary and the first diverter plate may then have no perforations.

If cooling fluid is moved through the central cavity, the cavity itself may contain a duct for carrying the cooling fluid directly to the first diverter plate to be metered into a high-temperature incoming heating gas stream. The cavity itself may act as a duct in certain embodiments, without the requirement of any additional duct within it. If at least a portion of the cavity is to serve as a duct for cooling fluid, the end of that portion serving as a duct which is closest to the screw shaft second end would preferably be scaled against the entry of any fluid but cooling fluid by a second diverter plate, the plate generally being perforated to admit cooling fluid from a duct with which the plate scalingly communicates. In the case where a cooling fluid duct scalingly communicates (as through a rotary joint seal) directly with the central cavity, the function of the second diverter plate, including any allowance for recirculation of exiting heating gas into the cooling fluid stream, would then be performed by the directly-communicating duct.

An example of the second divertor plate function would be the diversion of fluids other than ambient (outside) air from a duct, e.g., keeping heating gas exiting the gas guide from entering the duct. In that case, only outside air would enter the inner cavity for eventual injection into the incoming heating gas stream. Note, however, that at least a portion of the cooling fluid may in certain embodiments comprise heating gas which is entrained in a cooling air flow as the heating gas exits the gas guide. Such a recirculation of a portion of the heating gas as part of the cooling fluid stream could conserve energy previously added to and still carried by the recirculating heating gas, but in preferred embodiments described herein would require venting of at least a portion of the exiting heating gas. Such venting would allow for addition of a new stream of higher temperature heating gas to the recirculating (cooling and diluting) gas flow before the combined recirculated and new heating gas flows enter the gas guide.

Relatively smaller diameter screw shafts may differ from the larger double-wall embodiments in that they may contain no diverter plates but comprise instead a single screw shaft wall wherein a gas guide for heating gas occupies substantially the the entire space within the screw shaft wall and between the first and second bearing areas (which are firmly coupled to the screw shaft wall at the respective rust and second screw shaft wall ends). Firm coupling is achieved by, e.g., welding, riveting, or bolting the firmly coupled structures either directly together or to one or more intermediate structures which are themselves firmly coupled.

Heating gas for either single-wall or double-wall screw shafts may comprise, e.g., exhaust gas from a propane, natural gas or fuel oil burner. Because heating gas loses heat as it flows through a gas guide from the first end to the second end of a screw shaft, the screw shaft first end is generally at a higher temperature than the second end. Thus a thermal gradient is established along the screw shaft longitudinal axis. Heat transfer from the heating gas to various portions of the screw shaft wall may be optimized by controlling the heating gas temperature proximate the screw shaft first end (e.g., by controlled addition of cooling/diluting fluid, preferably comprising air), by modulating the heating gas flow rate, and by altering the gas guide design to obtain a desired (predetermined) pattern of heating gas velocities and turbulances within the gas guide and adjacent to the screw shaft wall. Additionally, thermal conductivities of structures comprising the gas guide may be modified to alter both the rate and distribution of heat transfer from heating gas to the screw shaft wall to optimize conditions for desorption of volatile or semivolatile components of any semisolid material in contact with flights on the outer surface of the screw shaft.

Heating gas may enter each screw shaft first end at a relatively high temperature (having been preheated by a heat source outside the screw shaft), or the heating gas may be elevated to a high temperature substantially within each screw shaft by a fuel burner assembly substantially centered therein and adjustably coupled thereto. Heating gas entering a screw shaft first end, whether preheated or in the form of separate fuel and oxidizer to feed a fuel burner positioned within the screw shaft, is generally directed axially toward the screw shaft second end until it strikes a gas guide (in single-wall screw shafts) or the substantially circular and substantially transverse first diverter plate (in double-wall screw shafts). A first diverter plate, if present, is substantially centered within and sealingly coupled to the internal chamber wall; the plate is proximate the internal chamber wall first end and positioned substantially transverse to the screw shaft rotational axis. Note that such transverse position of the diverter plate may be indicated by the tendency of the plate in such a position to substantially uniformly redirect to a gas guide a substantially axially directed heating gas stream which enters a double-walled screw shaft proximate its first end. As noted above, cooling and diluting fluid may be added to the heating gas stream by ducting such cooling and diluting fluid through the screw shaft second end and forcing it through one or more (preferably symmetrical) perforations made for this purpose in the substantially circular first diverter plate.

If cooling fluid enters a screw shaft through the second screw shaft end, cooling fluid inlet means are preferably used to substantially prevent mixing of cooling fluid and exiting heating gas as both pass through the second beating area in substantially opposite directions. Cooling fluid inlet means thus comprise a (preferably substantially cylindrical) cooling fluid duct sealingly communicating with the internal chamber central cavity (directly or via a second diverter plate) and preferably being substantially coaxial therewith. The cooling fluid duct is preferably substantially centered in the second bearing area and sealingly communicating (directly or via a portion of the central cavity) with a plurality of perforations in the first diverter plate (i.e., so as to be capable of delivering pressurized cooling fluid through the perforations).

When exiting the gas guide of a screw conveyor desorber proximate a screw shaft second end, heating gas preferably passes through the screw shaft second bearing area before being vented to the atmosphere. Because the heating gas has been substantially shielded by each screw shaft wall from direct contact with contaminated material, vaporized (contaminant) fractions from material in contact with the external flight(s) are substantially absent from the heating gas stream as it leaves each screw shaft. Vaporized contaminants, in contrast, are substantially contained in a contaminant vapor space between each screw shaft outer surface and a conveyor wall which substantially surrounds the screw shaft(s) except for portions proximate the first and second bearing areas. The conveyor wall has an inner surface and an outer surface, at least a portion of the conveyor wall inner surface being spaced an effective distance from at least a portion of the (at least one) substantially helical external flight(s) to facilitate self-cleaning and material transport as described herein. Contaminant vapors may then be drawn from the contaminant vapor space by fans or pumps for further processing and/or decontamination.

In screw conveyors of the present invention, the conveyor wall effectively encloses each screw shaft except for portions of the first and second screw shaft bearing areas of each screw shaft, through which heating gas passes (respectively) into and out of the screw shaft. For applications where contaminant gases are flammable, it is preferable that no air mix with the hot (desorbed) gases within the contaminant vapor space because of the danger of fire or explosion. To substantially preclude air from entering the contaminant vapor space (between the conveyor wall inner surface and each screw shaft outer surface) where such mixing may occur, first and second rotating seals (comprising, e.g., substantially cylindrical metallic bellows, packing material for maintaining sliding contact with a bearing area, and one or more glands for compressing the packing material) may be used between each first and second (rotating) screw shaft bearing area and the (nonrotating) portion of the conveyor wall proximate each of the first and second bearing areas respectively. Where, on the other hand, mixture of air with heated contaminant vapors would not constitute a safety hazard, rotating seals may be eliminated, leaving only closely fitting (but non-contact) portions of the conveyor wall adjacent each bearing area of each screw shaft. Such non-contact conveyor wall portions may substantially restrict but not entirely block the passage of air into the contaminant vapor space under the influence of a negative pressure gradient (maintained by fan or pump) from the ambient atmosphere to the contaminant vapor space.

When acting as a part of a screw conveyor desorber, each screw shaft of the present invention is supported by a screw shaft bearing assembly pair comprising first and second bearing assemblies spaced apart and adjustably coupled to a framework. The first and second bearing assemblies of each bearing assembly pair act at the first and second bearing areas respectively of a screw shaft. Each of the first and second bearing assemblies is adjustably coupled (e.g., bolted, screwed or clamped) to the framework to provide for rotation of the supported screw shaft about the centered longitudinal screw shaft rotational axis while the screw shaft rotational axis is held in a substantially fixed spaced relationship to the conveyor wall to which the framework is substantially firmly coupled. Note that in some embodiments of the present invention, the framework may comprise substantially all or a portion of the conveyor wall itself.

Each screw shaft is associated with rotary drive means firmly coupled to the screw shaft wall, preferably to either or both of the first and second screw shaft bearing areas. Rotary drive means may comprise, e.g., one or more sprockets, pulleys and/or gears. In a screw conveyor, each drive means is drivingly coupled to one or more rotary power sources (as by chain, belt or gear drives), the power source(s) being adjustably coupled to the framework and capable of transmitting torque to each screw shaft. The torque is preferably substantially about the screw shaft rotational axis, and when transmitted through both first and second bearing areas, may not be equally divided between the two areas.

Rotary drive torque tends to cause each screw shaft to rotate about its rotational axis, resulting in relative motion of the screw shaft external flight(s) with respect to the conveyor wall. This flight-wall relative motion taking place at an effective flight-wall distance between at least a portion of each screw shaft flight and the conveyor wall tends to aid in semisolid material mixing and transport in the desorber. In conjunction with other elements of the present invention described herein, the flight-wall relative motion may facilitate self-cleaning of the desorber during screw shaft rotation. The effectiveness of both transport and self-cleaning functions may depend on several parameters (e.g., the height of the screw shaft external flight(s) above each screw shaft outer surface relative to the wall-flight distance from the conveyor wall to the nearest screw shaft flight surface) which are preferably determined empirically.

To maintain an effective wall-flight distance for self-cleaning and material transport, at least a portion of the conveyor wall shape substantially conforms to at least a portion of each screw shaft outer surface and thus to the outer edge of the at least one substantially helical external flight which is firmly coupled to the screw shaft outer surface in question. The conforming wall portion is thereby spaced apart from the screw shaft outer surface a distance which is effective for transporting semisolid material in the manner of a screw conveyor. Thus, the minimum wall-flight distance (i.e., the distance measured from the inner surface of the conveyor wall to the closest portion of a screw shaft flight) is always greater than zero but preferably less than an empirically determined distance which, if exceeded, would substantially impair material transport.

A plurality of hardened bits may optionally be substantially firmly coupled to the external flight(s) outer edge(s) and extend both above and to either side of each flight outer edge, thus increasing the minimum distance from the conveyor wall to the screw shaft outer surface by at least the bit height (i.e., the radial distance from the bit base to the bit outer edge). When the screw shaft is rotated, each bit outer edge (which is substantially parallel to the portion of screw shaft outer surface over which it is positioned) describes a substantially right circular cylindrical pathway in space. The wall of each said spatially described right circular cylinder comprises the longitudinal bit sweep, which locates and defines the longitudinal length of the area which will be swept by that bit adjacent to the conveyor wall.

For optimal conveyor wall cleaning, each said longitudinal bit sweep will abut (adjoin) or slightly overlap the longitudinal bit sweep of the bit which just precedes and/or follows the bit in question on the screw shaft flight(s). In the case where a plurality of hardened bits is substantially evenly spaced along at least one substantially helical external flight outer edge and where the corresponding bit sweeps combine to form a substantially contiguous composite sweep, the composite sweep will preferably be equal in length to the effective longitudinal flight length. The hardened bits can thus automatically prevent adherent material buildup on the conveyor wall from interferring with screw shaft rotation for at least a portion of the screw shaft length, preferably the entire effective longitudinal flight length of each screw shaft.

Screw shaft rotation may also optionally activate scraping action on the flights and/or screw shaft outer surfaces of two or more adjacent counter-rotating screw shafts having opposite-handed external flights, each screw shaft having one or more external flights which mesh with (i.e., overlap) one or more corresponding external flights on the adjacent screw shaft. Such meshing allows portions of flights on adjacent screw shafts to interleave without interference during simultaneous rotation of the screw shafts. Additionally, one or more breaker devices coupled to the framework (where coupling to the framework may be through a portion of the conveyor wall) preferably maintain at least intermittent slidingly contact with at least a portion of the external flight(s) and/or the screw shaft outer surface of each screw shaft to automatically keep flight surfaces and/or the screw shaft outer surface of each screw shaft substantially free of adherent deposits while simultaneously aiding in the mixing of transported material to enhance heat transfer and desorption. Breaker device coupling to the framework through the conveyor wall is preferably sliding, springing, and/or sliding and springing.

DETAILED DESCRIPTION

Figure 1A:
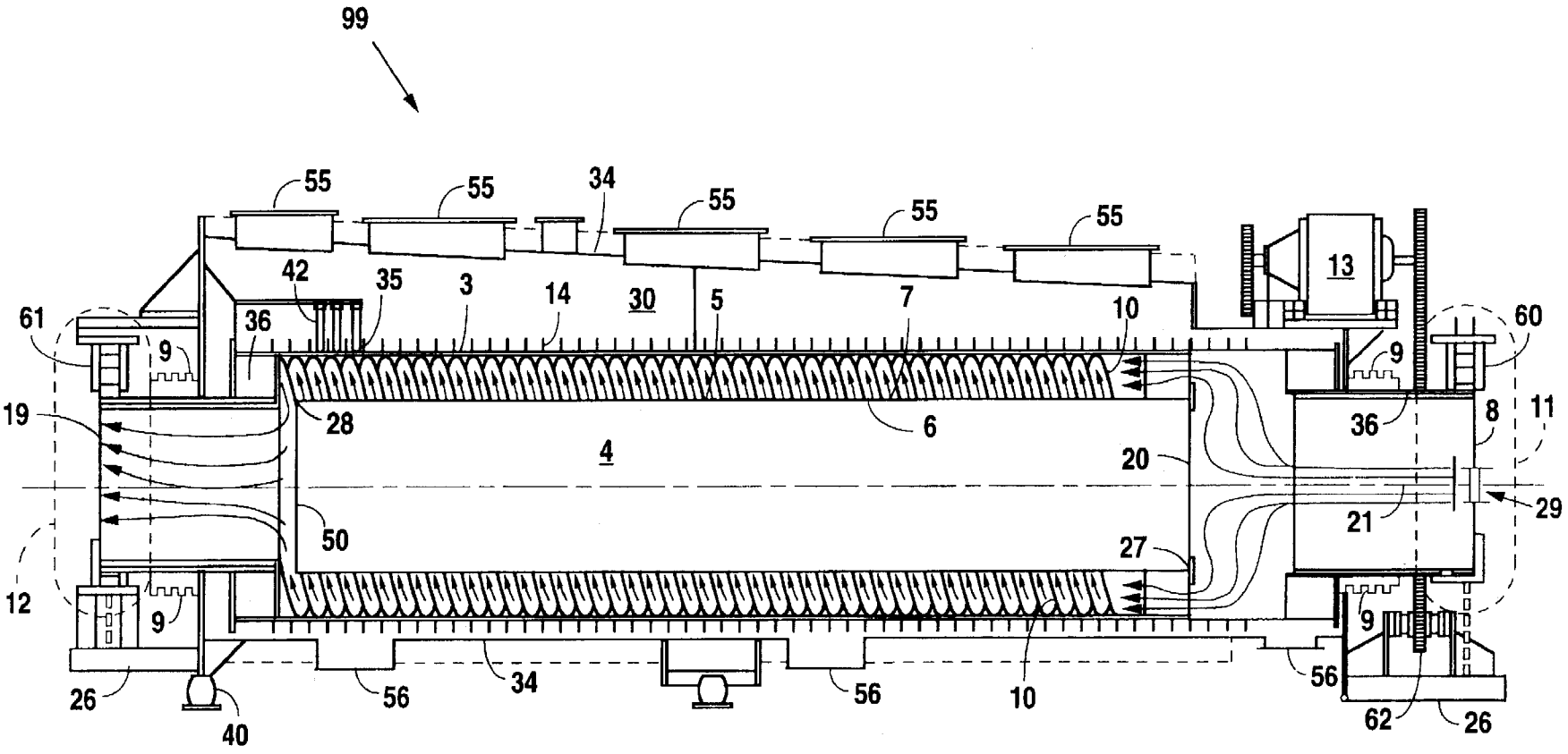
FIG. 1A schematically illustrates a longitudinal partial cross-sectional view of a double-wall indirect-heating desorber with cooling fluid introduced at a (diluting) burner within the screw shaft.

Various preferred embodiments of the present invention may include parts which, while in analogous positions, differ in certain structural and/or functional respects. Throughout this description, such analogous parts are identified by reference numbers on the drawing(s) in which the parts are illustrated most dearly, the various alternative embodiments being identified in each case by the reference number unprimed, the primed reference number (′), the double-primed reference number (″), etc. Note that while the drawings and descriptions herein provide representative schematic illustrations and explications of several preferred embodiments of the present invention, those skilled in the art will recognize that the invention is not intended to be limited to the specific forms set forth herein, but on the contrary is intended to include such alternatives, modifications and equivalents as can reasonably be included within the spirit and scope of the invention as defined by the appended claims.

Figure 1B:
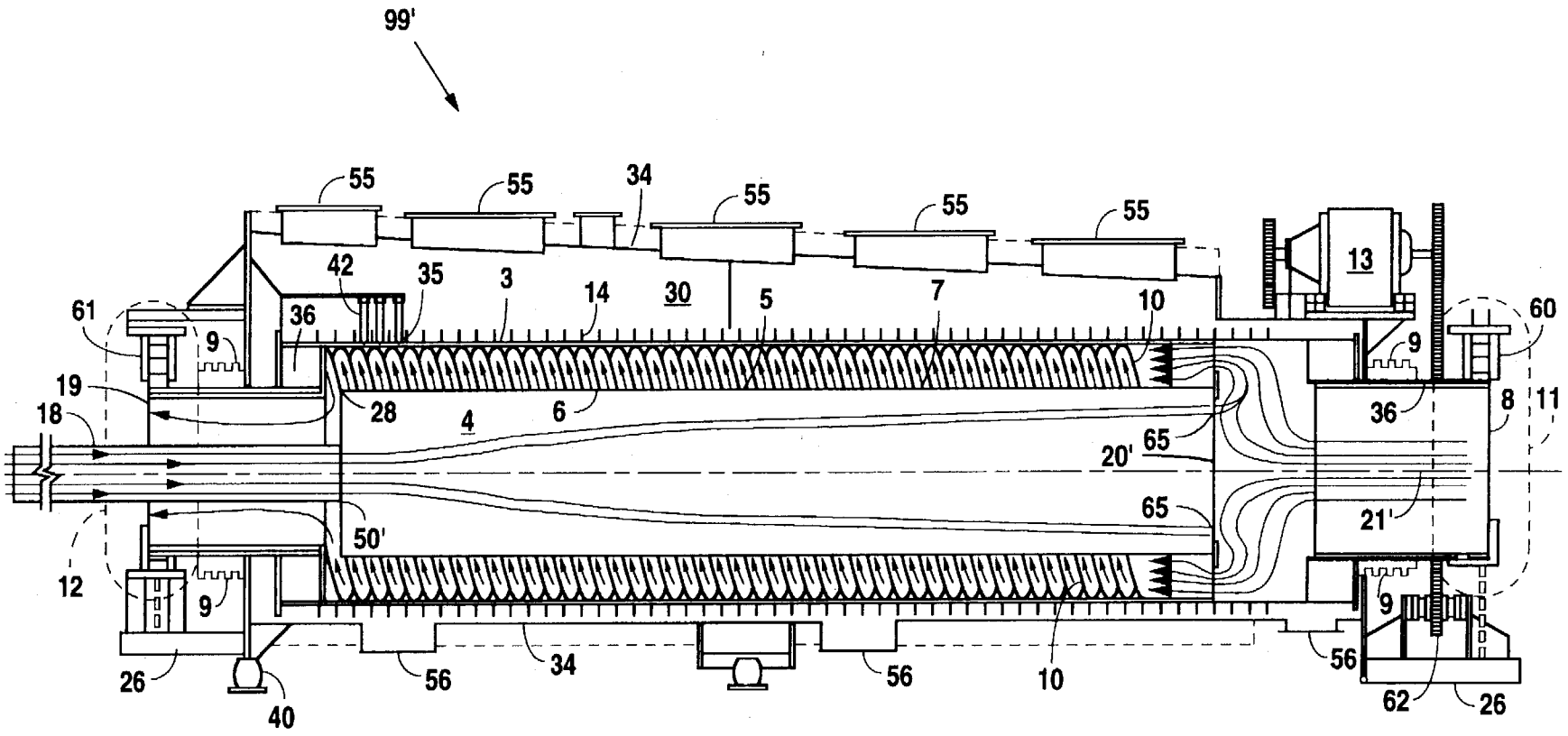
FIG. 1B schematically illustrates a longitudinal partial cross-sectional view of a double-wall indirect-heating desorber with cooling fluid inlet means introducing cooling fluid through the screw shaft second end to mix with heating gas heated outside of the desorber.
Figure 1C:
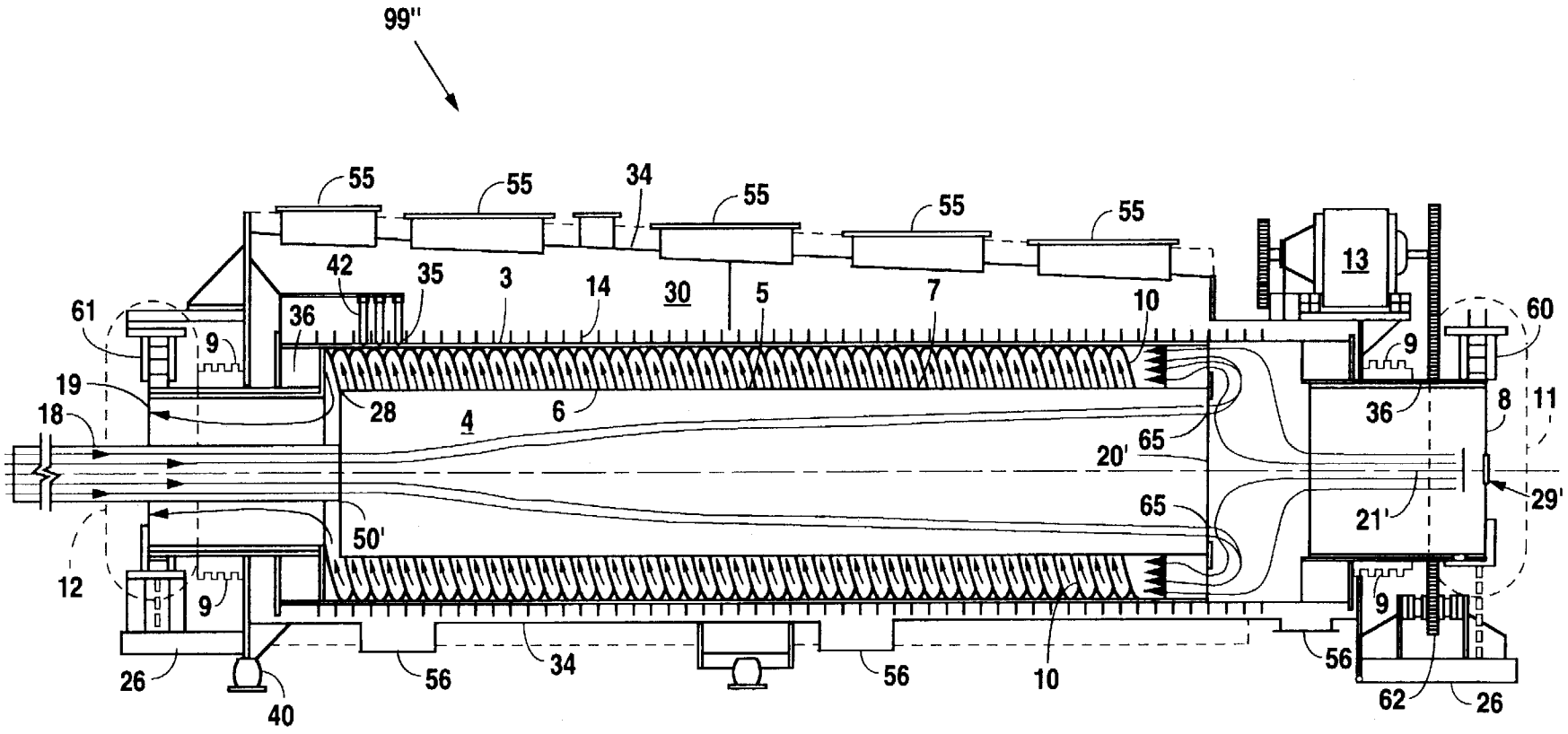
FIG. 1C schematically illustrates a longitudinal partial cross-sectional view of a double-wall indirect-heating desorber with cooling fluid inlet means introducing cooling fluid through the screw shaft second end to mix with heating gas from a high-temperature burner within the screw shaft.

For example, the preferred embodiments of desorbers 99, 99', 99" of the present invention as shown in FIGS. 1A, 1B and 1C respectively illustrate different approaches to addition of cooling fluid to a heating gas stream. In FIG. 1A, fuel, air, and cooling fluid enter a diluting burner 29 centered within the first screw shaft bearing area 11 proximate screw shaft first end 8 to produce a heating gas stream 21 at a suitable temperature for entry to the gas guide 10 without the need for additional dilution with cooling fluid. Thus, first diverter plate 20 in FIG. 1A requires no perforations to allow passage of cooling fluid, whereas first diverter plate 20' (as in FIGS. 1B and 1C) has one or more perforations 65 (preferably in a substantially symmetrical pattern) to allow passage of cooling fluid which enters the screw shaft second end 19 through cooling fluid inlet means (including cooling fluid duct 18 and second diverter plate 50' in FIGS. 1B and 1C) and eventually mixes with heating gas stream 21. A perforated first diverter plate 20' is thus particularly useful for accommodating high-temperature fuel burners 29' positioned proximate screw shaft first end 8 and producing a relatively high-temperature heating gas stream 21', as in FIG. 1C. Note that a high-temperature heating gas stream 21' produced from a source outside a screw shaft as in FIG. 1B will also require dilution with a cooling fluid proximate perforated first diverter plate 20' before entering gas guide 10.

Figure 1D:
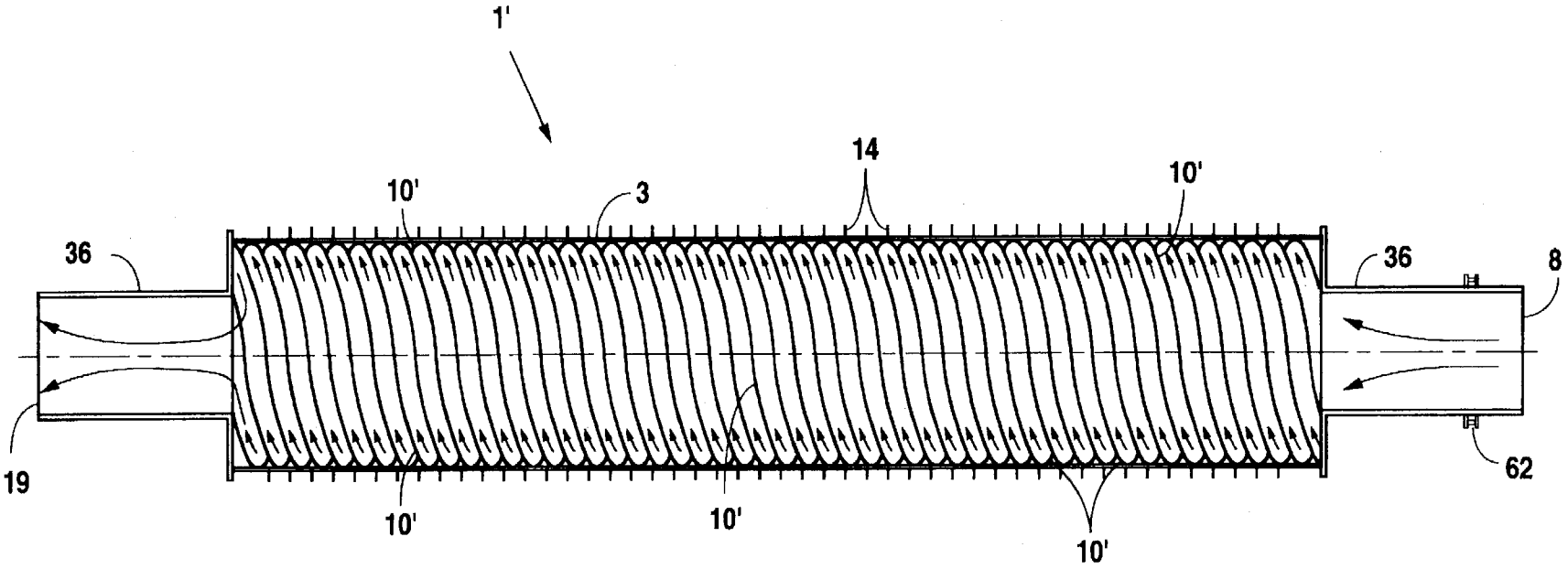
FIG. 1D schematically illustrates a longitudinal partial cross-sectional view of a single-wall indirect-heating desorber screw shaft.

Alternative screw shaft configurations having both first diverter plate 20 and second diverter plate 50 non-perforated (as in FIG. 1A), or no diverter plate at all (as in the single-wall screw shafts illustrated in FIGS. 1D and 1E), require use of heating gas in that screw shaft which has been preheated to an effective temperature for desorption but not above a maximum acceptable temperature. Excessively high heating gas temperatures are avoided to prevent screw shaft overheating and subsequent undesired pyrolysis or phase change of portions of the transported material (including contaminants), and/or to prevent fouling of screw shaft and conveyor wall surfaces with adherent deposits. Note that the objective of all dilutional cooling of the heating gas is to ensure that the heating gas maximum temperature on entry to a gas guide 10 is low enough to avoid such overheating of any portion of the screw shaft outer surface 3 or the external flight(s) 14 thereon during passage of the heating gas through the gas guide 10.

In preferred embodiments of desorbers of the present invention 99, 99', 99", the uppermost portion of the conveyor wall 34 encloses a vapor dome area 30 where heated contaminant gases may collect prior to being drawn off for further processing and/or decontamination. Portions of the conveyor wall 34 around the vapor dome area 30 have one or more access ports 55 for removal of contaminant vapors and/or addition of contaminated material to the desorber. At least one material outlet 56 is also provided in the conveyor wall 34, typically spaced apart from and lower than the material inlet(s) 55.

In preferred embodiments of the present invention, first and second screw shaft beating areas 11,12 preferably comprise double-wall cylindrical portions 36 which may be cooled by forced (active) or passive circulation of cooling fluid (preferably comprising air) through the double-walled cylindrical portions 36. This cooling provides thermal protection of, e.g., first and second screw shaft bearing assemblies 60,61, rotary seals 9, rotary drive means 62, and rotary power source 13 from relatively high screw shaft temperatures. Such cooling of screw shaft bearing areas 11,12 may be accomplished on either double-walled screw shafts 1 or single-walled screw shafts 1', either embodiment being suitable for incorporation of double-walled cylindrical portions in either first or second bearing areas 11,12 respectively or both.

Material is transported in screw conveyors 99,99',99" of the present invention in part by the action of external screw threads or flights 14, which act as inclined planes to convert rotary motion of the screw shaft 1,1' to movement of the material in a direction substantially parallel to the longitudinal (rotational) axis of the screw. Material transport (throughput) capacity may be increased or decreased for a given desorber by tilting (pivoting) the centered longitudinal (rotational) axis through a tilt angle so that the first and second ends of a screw shaft are at different elevations with respect to a horizontal plane. In preferred embodiments, such tilting of the centered longitudinal axis may be accomplished by rotating the framework 26 about a pivot 40 mounted on the framework.

Transported material is maintained in sliding contact with at least a portion of the flight(s) 14 by a curved (substantially conforming) portion of the conveyor wall 34. The conveyor wall 34 is spaced proximate to but apart from the flights 14 along at least a portion of the length and circumference of screw shaft 1,1'. Transported material in sliding contact with the flight(s) 14 tends to be transported substantially from points proximate the second end 19 (i.e., the material input end) of the screw shaft 1,1' to points more proximate the first end 8 (i.e., the material output end). In the case of a constant-diameter screw shaft 1,1', at least a portion of the conveyor wall 34 is commonly in the form of a right circular cylinder (or longitudinal section thereof) which is substantially coaxial with the screw shaft's centered longitudinal rotational axis and thus surrounds at least a part of the screw shaft 1,1' at one or more fixed distances. A variant of this configuration is a trough having outwardly-sloping sides and a bottom substantially in the shape of a longitudinal hemisection of a right circular cylinder. Optimal values for the height X of flight outer edge 16 above screw shaft wall outer surface 3, the pitch Y, the bit height H and the flight-wall spacing distance Z (greater than zero) are chosen based in part on the nature of the material to be transported, including its particle or granule size range, its resistance to flow in the desorber, any tilt present in the desorber longitudinal axis, and the desired throughput capacity of the desorber.

In general, screw conveyors with external flights require relatively dose (but not zero) flight-wall spacing for relatively fine soils and sludge. If even small amounts of adherent compacted material are allowed to accumulate on flights, on inter-flight screw shaft outer surfaces, or on the conveyor wall, effective flight-wall spacing may reach zero and the screw may jam. Even without screw jamming, material accumulations on inter-flight surfaces may substantially decrease material throughput capacity by reducing the amount of material in effective sliding contact with a flight. Further, as flight-wall spacing approaches zero, torque requirements for conveyor operation may rise abruptly, resulting in excessive wear of rotary drive components, possible shaft breakage, and/or screw shaft beating assembly damage.

Besides maintaining a desired flight-wall spacing, desorbers of the present invention obviate the adverse effects of adherent deposits on inter-flight screw surfaces. Automatic removal of this material maintains the design throughput capacity for a conveyor as well as improving heat transfer efficiency from the heating gas through the screw shaft outer surface to the material being transported. Optional features, including control of rotary drive parameters (e.g., screw rotational speed and/or rotary drive torque), as well as modification of heat source parameters (e.g., fuel flow rate, burner heat output, fuel/air ratio, flame geometry and/or heat distribution patterns), may be employed in open or closed loop control systems to further increase desorber efficiency and reliability. In certain embodiments of the invention, a relatively high heat-output fuel burner may be used in conjunction with automatic closed-loop adjustment of heat source parameters and rotary drive parameters to allow adjustment of overall desorber operation to accommodate different types of contaminated material. Contaminated-material parameters including, for example, specific heat, material flow characteristics, contaminants present, moisture content and heat stability may be considered in making adjustments to conveyor heat source and rotary drive parameters using closed-loop control system methods.

In desorbers of the present invention, provision is made for automatic removal of caked, coked, fused, compacted, compressed or otherwise adherent masses of material on the screw and/or conveyor wall surfaces during screw rotation. Preferred embodiments provide for material removal from at least a portion of the screw shaft outer surface only, or from conveyor wall surfaces only, or from both screw and internal conveyor wall surfaces. Choice of a particular embodiment for a given material transport application depends on consideration of factors including the composition and consistency of material transported, the speed of screw rotation, and the temperatures of the transported material and various surfaces within the screw conveyor.

Because of the variety of granular or particulate materials that may require decontamination, and the differing tendencies of these materials to form adherent deposits, desorbers of the present invention may be adjusted for optimal performance with any given input material. Adjustments may be performed manually, or a desorber may incorporate closed-loop screw rotary drive controls in conjunction with closed-loop control of heat source parameters to effectively reduce the rate of adherent deposit buildup. Desorbers embodying the latter features would typically be capable of operation at sustained high screw temperatures and relatively high throughput rates by adjustment of rotary drive and heat source parameters to an optimal set for the material (s) presented for decontamination. Optimization criteria may include, for example, avoidance of overheating in any portion of the desorber, reduction of contamination to residual levels desired for particular contaminants, reduction of the total time required for a particular decontamination task, or minimization of fuel consumption. Algorithms for each parameter optimization program generally incorporate empirically-derived data for the particular desorber to which they are applied. Modification of the algorithms during desorber operation may be employed to make the desorber automatically adaptive to changes in parameters of the contaminated material.

Preferred embodiments of the invention may also include provision to apply predetermined (and optionally time-varying) forces to maintain one or more breaker devices in at least intermittent sliding contact (at their hardened tips) with at least a portion of the flight(s) and/or screw shaft outer surface during screw shaft rotation. Breaker devices preferably comprise hardened tips or contact surfaces of, e.g., tungsten carbide or other hard, tough material, and will preferably be firmly coupled to the conveyor wall and/or framework. Coupling may be passive (e.g., through one or more springs and/or sliding couplings) or active (e.g., through a hydraulic or pneumatic cylinder), and may be associated with passive or active damping of bit motion. Contact with desired inter-flight portions of the screw shaft outer surface and/or with a flight by a single breaker device may be maintained during screw rotation if the device is moved longitudinally in a coordinated manner so as to avoid interference with advancing flight surfaces.

For a breaker device coupled to the conveyor wall and/or framework, adaptation to maintain substantial sliding contact with the screw implies that the breaker device has a contact area (tip) which may be hardened, polished, reinforced and/or otherwise prepared to withstand sliding contact with the flight(s), the screw shaft outer surface, and any adherent deposits thereon. To avoid damage from interference with flights, a breaker device must be capable of at least limited motion in a direction substantially parallel to the screw shaft's centered longitudinal axis (i.e., longitudinal motion). Such longitudinal motion would allow the breaker device, for example, to maintain at least intermittent sliding contact with at least a portion of a flight and/or screw shaft outer surface even as the screw shaft is turning. In preferred embodiments, a plurality of breaker devices may be swept along passively by the advancing face of a flight or they may be actively advanced synchronously with the flight (i.e., away from the input end of the screw and toward the output end).

Passive longitudinal breaker device motion along at least a portion of the screw length may be accommodated by a coupling comprising a wall-coupled and/or framework-coupled spring; in certain embodiments, functions of the breaker device and the wall-coupled and/or framework-coupled spring are combined in a single spring. Such a breaker device is schematically illustrated in FIG. 4D, in which a plurality of springs 43 are coupled to the framework 26 and conveyor wall 34. As screw 1' rotates clockwise (indicated by the arrow adjacent second end 19), flights 14, firmly coupled to screw shaft outer surface 3 at flight base edge 15 tend to move springs 43 in the direction of the arrow on the upper surface of screw shaft 1'. Springs 43 are preferably in at least intermittent sliding contact with both screw shaft outer surface 3 and flights 14 as screw shaft 1' rotates, but springs 43 are eventually moved sufficiently longitudinally by sliding contact with flights 14 to cause flight outer edges 16 to lift springs 43 away from sliding contact with screw shaft outer surface 3. Continued screw shaft rotation at that point causes springs 43 to slide over a flight outer edge 16 and return under spring force back toward second end 19 to reestablish at least intermittent sliding contact with screw shaft outer surface 3. The sliding and returning motions of springs 43 during rotation of screw shaft 1' due to contact with flights 14 tends to automatically dislodge accumulated material from both flights 14 and screw shaft outer surface 3. If the amount of longitudinal spring motion that a single breaker device spring 43 can accommodate is insufficient to allow sliding contact with desired portions of the screw, a plurality of wall-coupled and/or framework-coupled spring breaker devices 43 may be spaced along the length of screw shaft 1', as schematically illustrated in FIG. 4D.

Figure 4A:
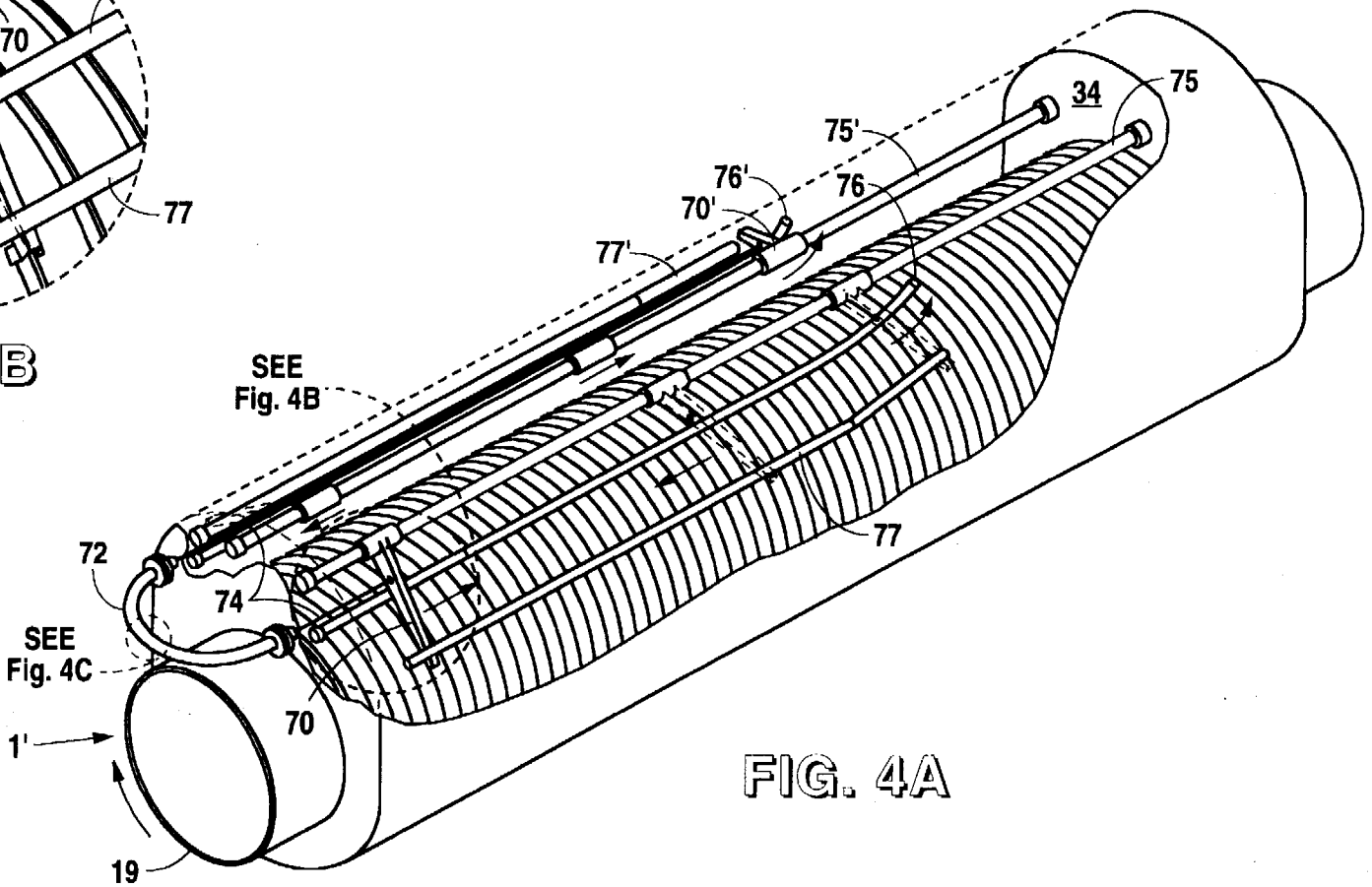
FIG. 4A schematically illustrates isometric views of a plurality of breaker devices slidingly coupled to the conveyor wall of a screw conveyor desorber.
Figure 4B:
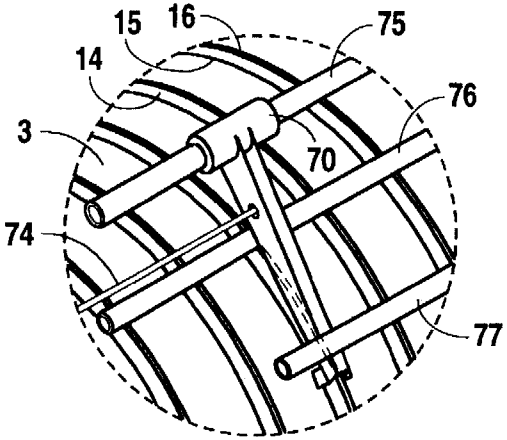
FIG. 4B schematically illustrates an enlarged view of a single breaker device as in FIG. 4A, with adjacent portions of a screw shaft and external flight(s).
Figure 4C:
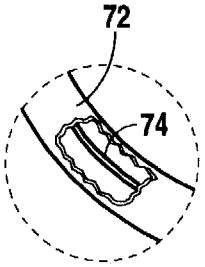
FIG. 4C schematically illustrates an enlarged view of the cable guide associated with the breaker devices as in FIG. 4A.
Figure 4D:
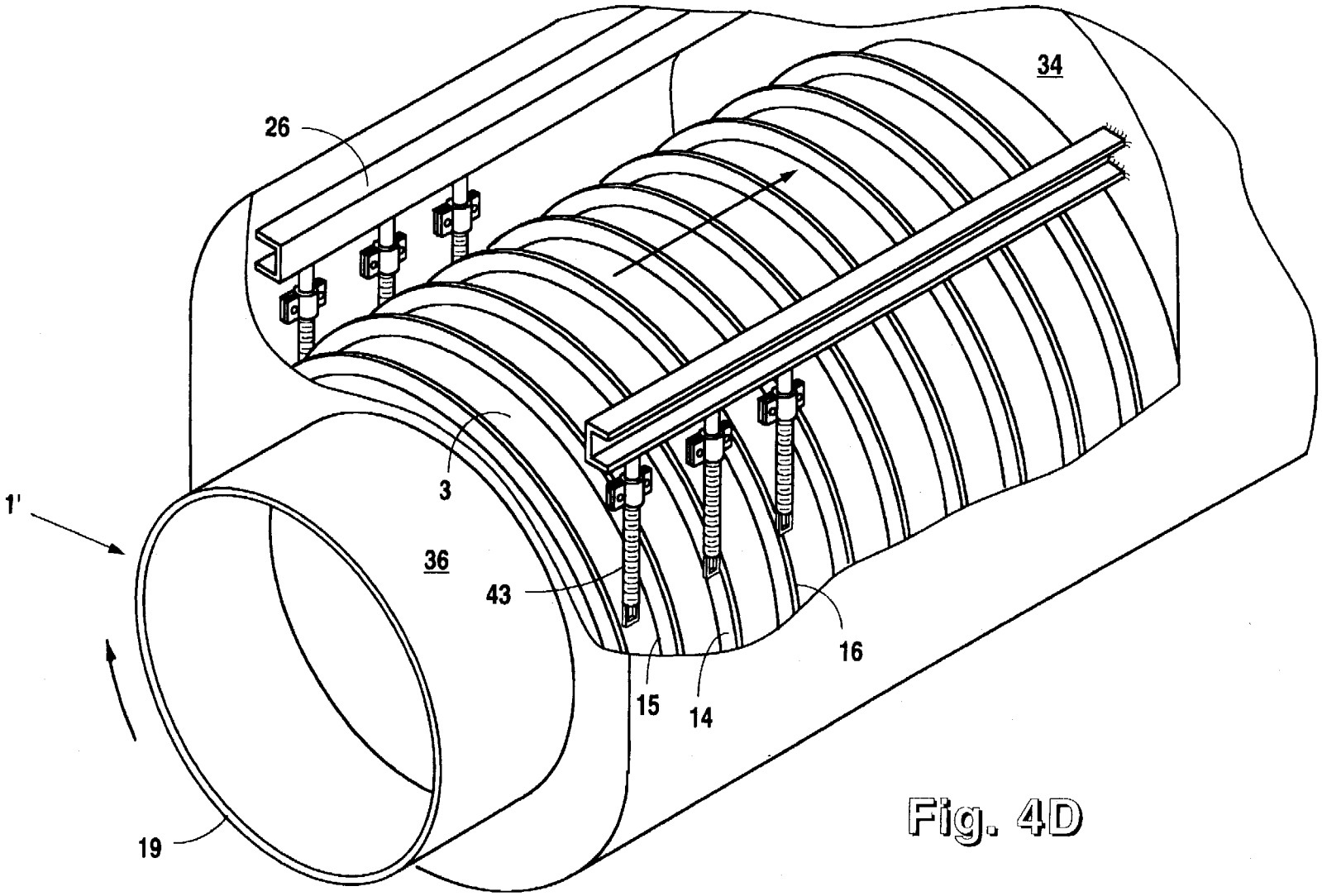
FIG. 4D schematically illustrates an isometric view of a plurality of breaker devices springingly coupled to the conveyor wall.

Longitudinal breaker device motion along at least a desired portion of the screw shaft length may also be accomplished as schematically illustrated in FIGS. 4A, 4B and 4C by a sliding coupling of breaker devices 70,70' to the conveyor wall 34 via guide rods 75,75', hold-down rods 77,77', and lifting rods 76,76' which rods are themselves firmly coupled to conveyor wall 34. Breaker devices 70,70' are flexibly coupled by cable 74 which travels in cable guide 72, cable 74 being substantially non-stretching and cable guide 72 being firmly coupled to conveyor wall 34.

An example of the operation of this slidingly coupled breaker device is schematically illustrated in FIG. 4A by reference to breaker devices 70,70' in initial positions A1,A2 respectively. In position A1, breaker device 70 is held in at least intermittent sliding contact with screw shaft outer surface 3 by hold-down rod 77. As screw shaft 1' then rotates clockwise as shown by the arrow adjacent second end 19, flights 14 (which are firmly coupled to screw shaft outer surface 3 at flight base edge 15) tend to push breaker device 70 away from second end 19 in the direction of the arrow adjacent breaker device 70 at position A1 (while breaker device 70 maintains at least intermittent sliding contact with flights 14 and screw shaft outer surface 3). Such movement of breaker device 70 tends remove deposits from flights 14 and screw shaft outer surface 3 and to place cable 74 in tension, which in turn tends to pull breaker device 70' (sliding on guide rod 75') from its initial position A2 toward second end 19. Note that as breaker device 70' moves toward second end 19, it slides over hold-down rod 77' (analogous to the subsequent returning position of breaker device 70 at position C1) and so is not in contact with flights 14 or screw shaft surface 3.

As breaker device 70 slides on guide rod 75 toward the end of its travel under hold-down rod 77, breaker device 70 tends to be lifted away from contact with flights 14 and screw shaft outer surface 3 by lifting rod 76. When breaker device 70 has been lifted dear of outer edge 16 of flight 14 by lifting rod 76, it is also lifted above hold-down rod 77 (see position B1), and simultaneously breaker device 70' reaches the end of its travel toward second end 19 and is no longer sliding over hold-down rod 77'. Thus, breaker device 70' is free to rotate on guide rod 75' into at least intermittent sliding contact with flights 14 and screw shaft outer surface 3 and, with continued clockwise rotation of screw shaft 1', tends to be moved by flights 14 in a longitudinal direction away from second end 19, contact with flights 14 being maintained because breaker device 70' is then held in at least intermittent sliding contact with screw shaft outer surface 3 by hold-down rod 77'. Thus, breaker device 70' then tends to exert tension on cable 74 which tends to return breaker device 70 (now prevented from contact with flights 14 or screw shaft outer surface 3 by sliding above hold-down rod 77) through position C1 and continuing back to the starting position considered in this illustrative example.

Figure 4E:
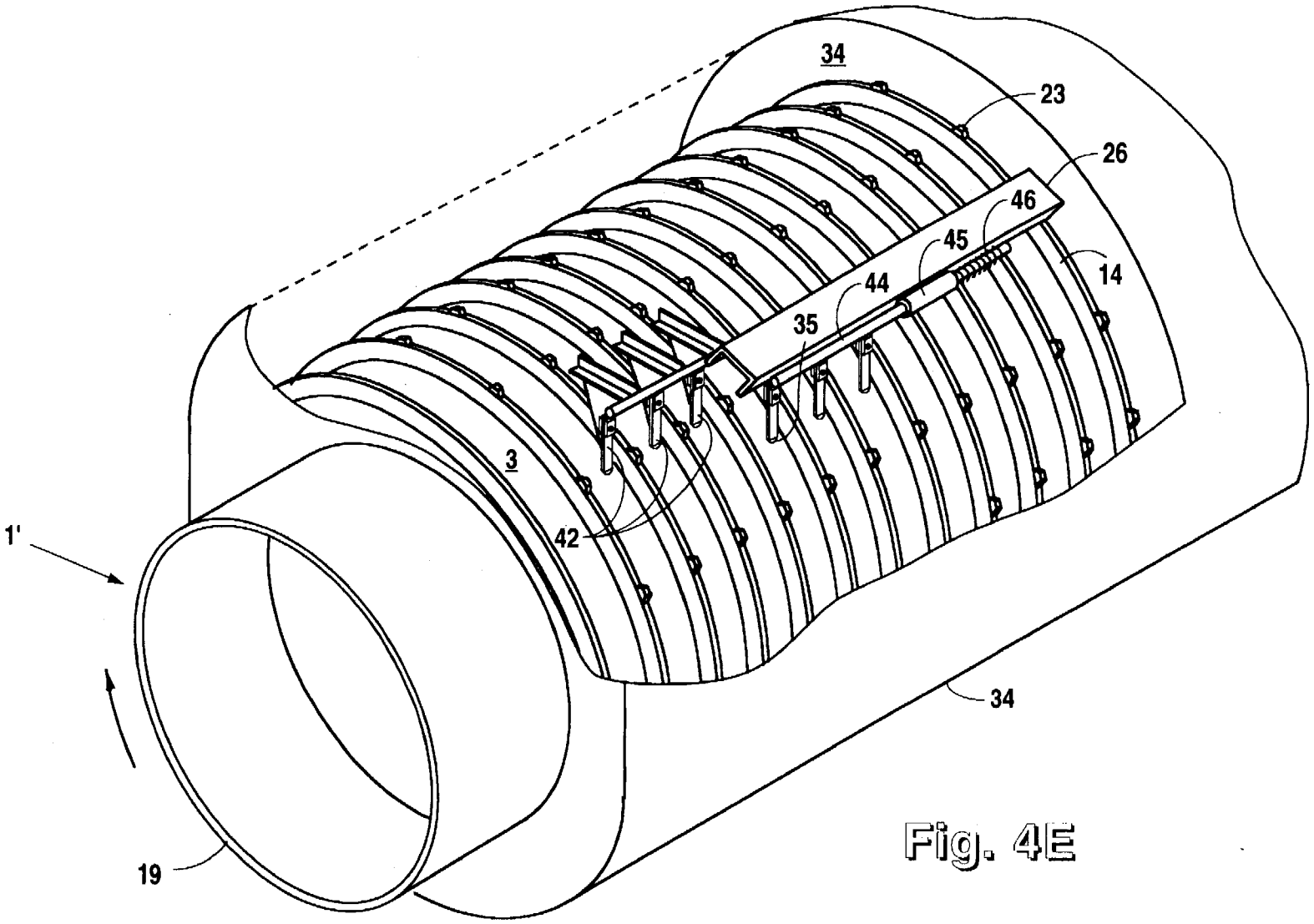
FIG. 4E schematically illustrates cutaway view of a plurality of breaker devices slidingly and springingly coupled to the conveyor wall.
Figure 4F:
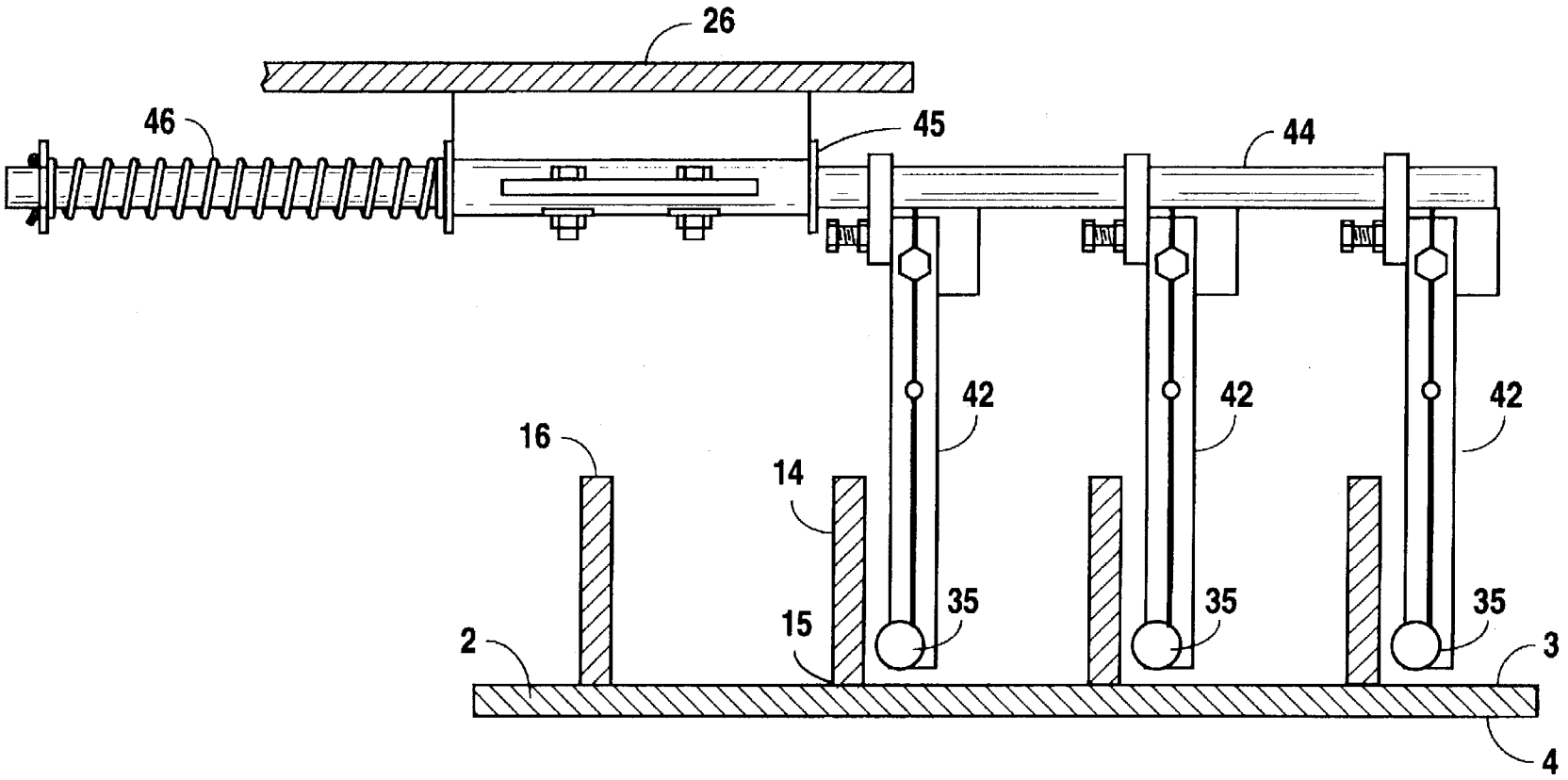
FIG. 4F schematically illustrates an end elevation of a plurality of breaker devices slidingly and springingly coupled to a conveyor wall, with a cross-sectional view of an adjacent screw shaft (including flight surfaces).

Another means of achieving longitudinal breaker device motion for a breaker device which in at least intermittent sliding contact with flights 14 and screw shaft outer surface 3 is schematically illustrated in FIGS. 4E and 4F. The breaker devices in this example are slidingly and springly coupled to conveyor wall 34. A plurality of breaker devices 42 is firmly coupled to base bar 44 which in turn is slidingly coupled to framework 26 (or alternatively through conveyor wall 34 to framework 26) through bearing 45. Spring 46 applies either spring tension or compression longitudinally in conjunction with spring torque to base bar 44 so that breaker devices 42 tend to be springingly rotated into at least intermittent sliding contact with screw shaft outer surface 3, while springingly resisting longitudinal movement of breaker devices 42 in response to sliding contact with flights 14 during clockwise rotation of screw shaft 1' (as indicated by the arrow adjacent second end 19). As flights 14 move and tend to exert ever greater force on breaker devices 42, breaker devices 42 tend to be rotated out of contact with flights 14 while spring 46 is either compressed or stretched, depending on the orientation of spring 46 with respect to the direction of rotation of screw shaft 1'. Progressive stretching or compression of spring 46 tends to increase the force of contact between breaker devices 42 and flights 14. The increasing contact force then tends to move the ball tips 35 of breaker devices 42 from positions relatively near the flight 14 base edge 15 toward the flight 14 outer edge 16, finally resulting in substantial loss of contact between breaker devices 42 and flight outer edge 16 as breaker devices 42 jump or skip over one surface of flight 14 to a corresponding position on a proximate flight 14 surface. During the skipping or jumping movement of breaker devices 42, spring 46 tends to return to a more neutral position (i.e., to a position where less longitudinal spring force is exerted on base bar 44).

Thus, depending on the orientation of base bar 44 and spring 46 with respect to the direction of rotation of screw shaft 1', breaker devices may be positioned to preferably be in at least intermittent sliding contact with flight(s) 14. By appropriate choice of positions and numbers of breaker devices 42, virtually any portion of flights 14 may be substantially cleaned of adherent material as a result of contact with breaker devices 42.

Figure 1E:
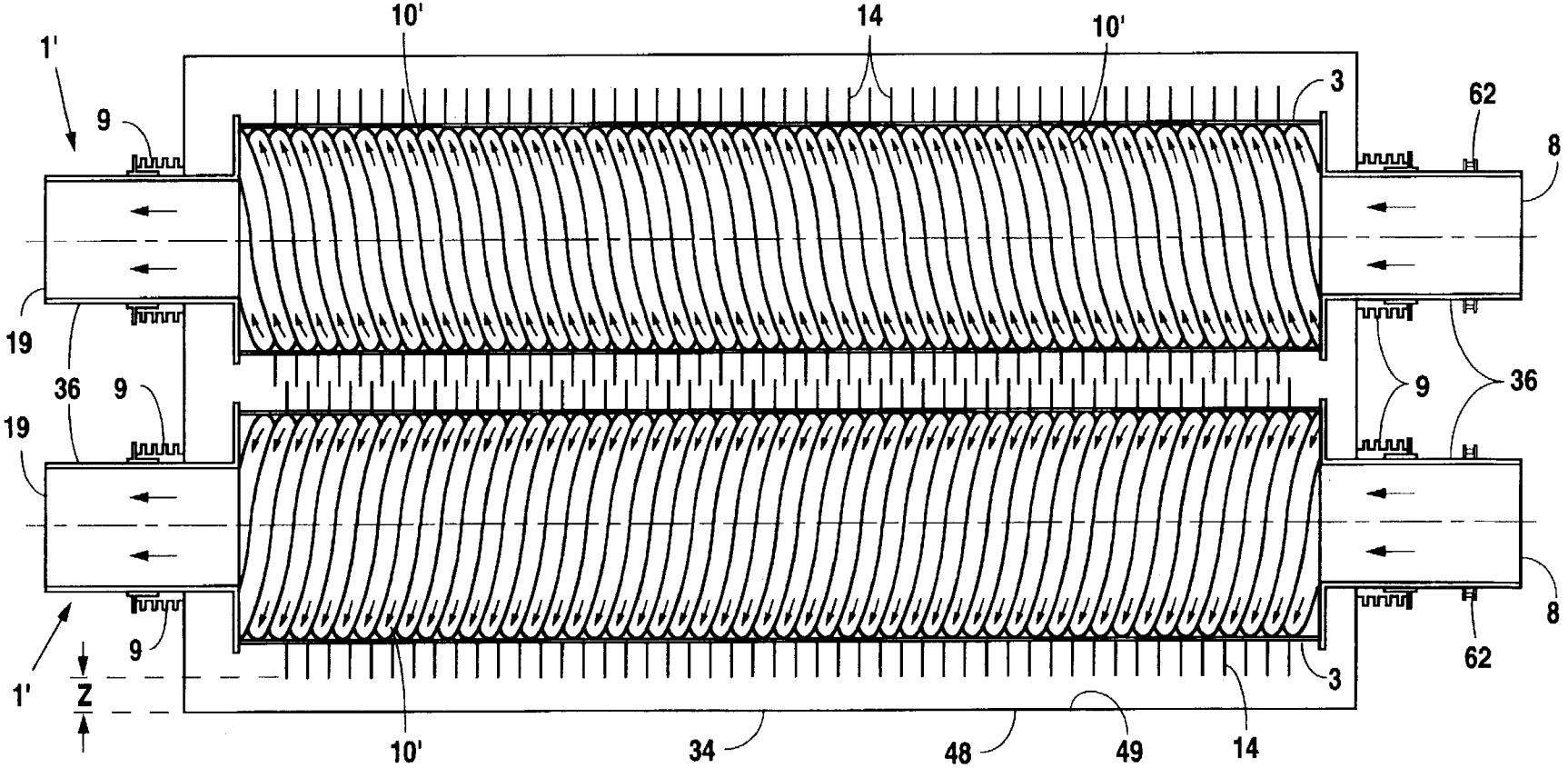
FIG. 1E schematically illustrates a cutaway view of portions of the screw shafts and conveyor wall of a twin-screw indirect-heating desorber comprising two single-wall screw shafts.
Figure 2:
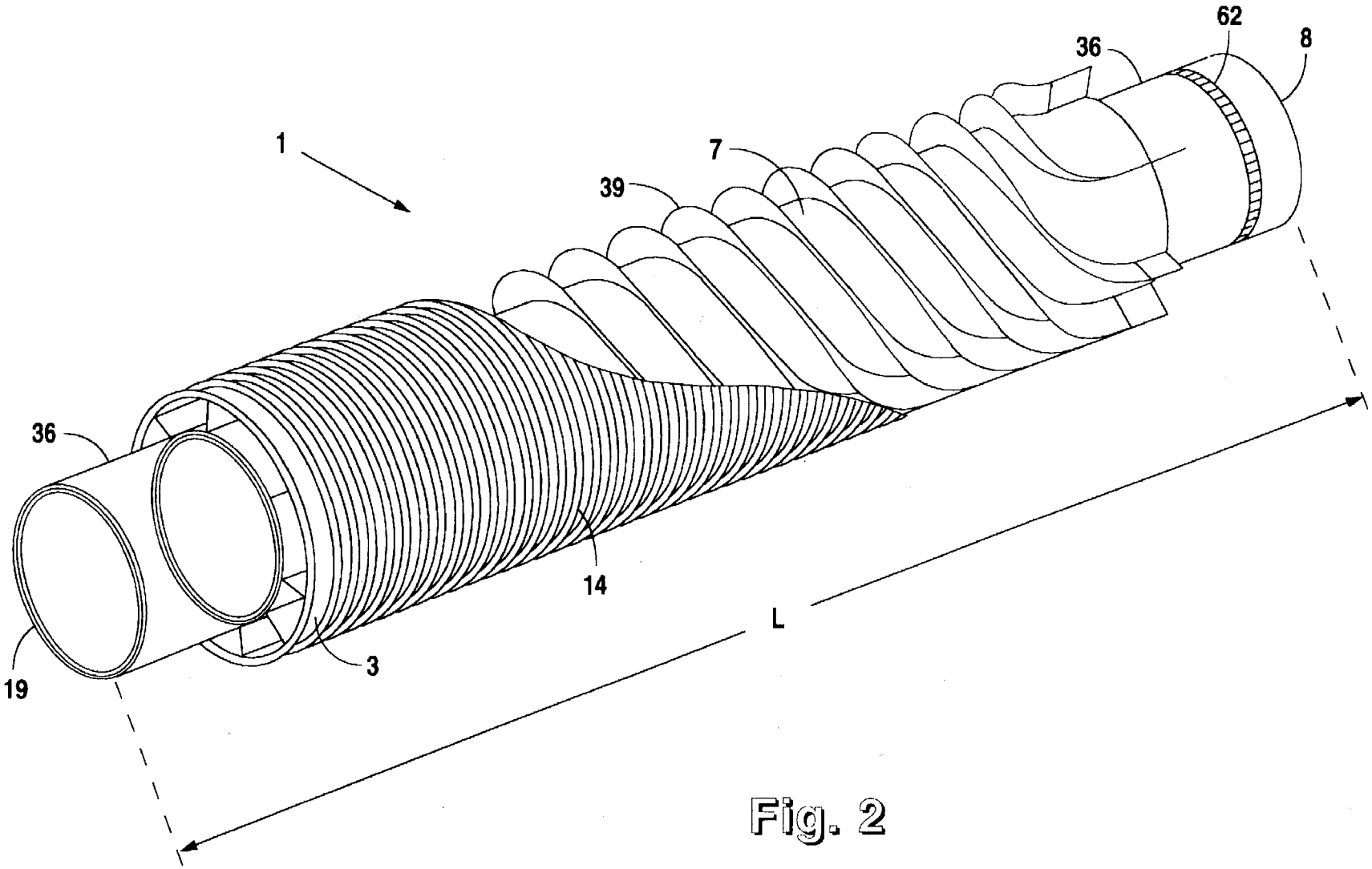
FIG. 2 schematically illustrates a cutaway view of gas guides on a double-walled screw conveyor screw shaft.
Figure 3A:
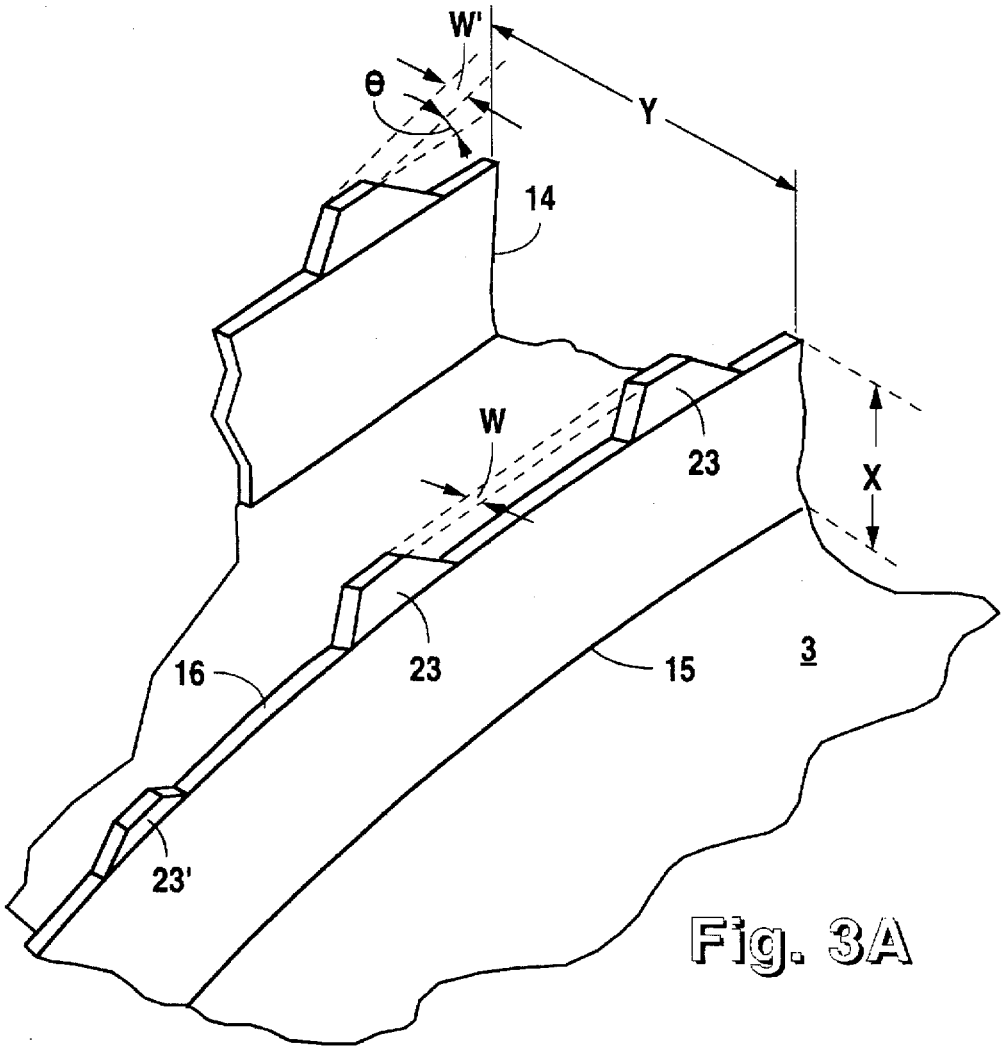
FIG. 3A schematically illustrates a plurality of hardened bits on adjacent flights.
Figure 3B:
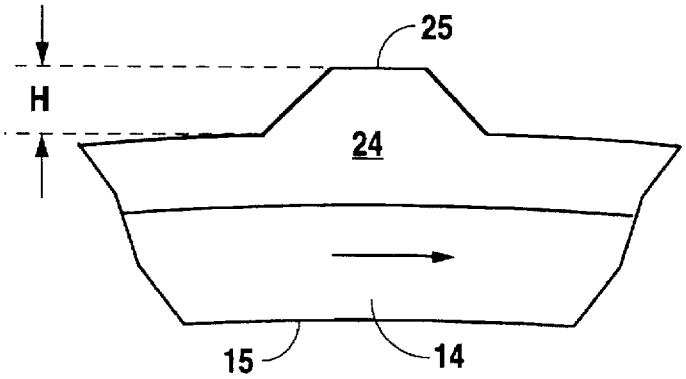
FIG. 3B schematically illustrates a side elevation of a hardened bit.

Preferred embodiments of the present invention may include bits 23 of hardened, tough material substantially firmly coupled to a flight and/or the screw shaft surface so as to extend above the flight a distance (i.e., the bit-height distance H) greater than zero but less than the flight-wall distance Z (the former distance illustrated in FIG. 3B and the latter distance illustrated in FIG. 1E). Note that bits 23 as illustrated schematically in FIGS. 3B and 3C may comprise a hardened surface 24 which may extend over at least an adjacent portion of external flight(s) 14. Such a hardened surface 24 may be achieved, e.g., through sputtering, welding and/or heat treating bits 23 and/or external flight(s) 14. Bits 23 in certain preferred embodiments are substantially similar in size and spaced substantially evenly along a flight so that a plurality of bits of width W and an angular orientation angle Θ with respect to a perpendicular to the longitudinal (rotational) axis of the screw shaft 1,1' will together sweep a substantially uninterrupted portion of space in the shape of a right circular cylinder proximate conveyor wall 34 on rotation of the screw shaft 1,1'. This substantially uninterrupted spatial sweep will occur when the effective longitudinal bit sweep W' for each bit inside the end bits of the plurality abuts (adjoins) or slightly overlaps the effective longitudinal bit sweep of the bits which just precede and follow the bit in question on the screw shaft flight(s).

Figure 3C:
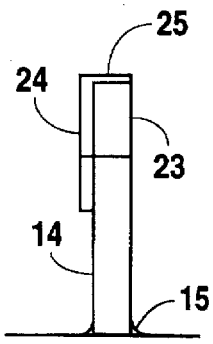
FIG. 3C schematically illustrates a cross-section of a hardened bit.

As illustrated in FIGS. 3A, 3B and 3C, each bit outer edge 25 is preferably substantially parallel to the portion of screw shaft outer surface 3 over which it is positioned, thus allowing bit outer edge 25 to describe the desired substantially fight circular cylindrical pathway in space on rotation of screw shaft 1,1'. The wall of each said spatially described right circular cylinder comprises the longitudinal bit sweeps of all bits 23 on the screw shaft 1,1' in question.

For optimal conveyor wall cleaning in at least a local portion of a screw shaft 1,1', each bit's longitudinal bit sweep will be substantially equal to the longitudinal bit sweep of each of the other bits 23 which comprise the plurality of bits on a given screw shaft 1,1' portion. For example, six bits 23, each having an effective longitudinal bit sweep of about one-inch may be substantially evenly spaced (i.e., about every 60 degrees) along a substantially helical flight 14 having a six-inch pitch Y. This bit spacing will ensure that the effective longitudinal bit sweeps for the six bits will together form a substantially contiguous composite sweep of total effective longitudinal length of about six inches. In preferred embodiments, the substantially contiguous composite sweep length is substantially equal in length to the effective longitudinal fight length (i.e., the longitudinal length of that portion of the screw shaft outer surface 3 to which flight(s) 14 are firmly coupled).

Bit widths W may preferably lie within the range of about 0.5 to about 6 inches, but the effective longitudinal bit sweep W' may exceed bit width W if bits 23 are positioned as described above at an angle Θ to a plane perpendicular to the rotational axis of screw shaft 1,1'. In determining the effect of such angular positioning of bits 23 on their effective longitudinal bit sweep, the shape of bit outer edge 25 must be considered, the optimal bit outer edge 25 shape having been empirically defined.

In embodiments of the present invention wherein the mechanical properties (e.g., hardness, friability) of adherent deposits may vary significantly from one end of screw shaft 1,1' to the other, use of non-uniform bit widths and/or inter-bit spacing may be desired to aid in equalizing reaction torque arising from different longitudinal portions of the screw shaft 1,1' (resulting from movement of contaminated material during screw shaft rotation). Additionally, bits 23 are preferably coupled to flight(s) 14 so as to allow relatively easy repair/replacement. Regardless of the spacing chose, in preferred embodiments sufficient bits 23 will be spaced along one or more flights to ensure that substantially all adherent deposits on the conveyor wall which could interfere with screw shaft rotation are effectively scraped by at least one bit, thereby substantially preventing screw shaft jamming due to contact of one or more flights with adherent deposits.

On portions of the conveyor wall 34 having such adherent deposits, a plurality of substantially equally spaced bits 23 firmly coupled to a screw shaft 1,1' may periodically remove chunks of deposited material or scrape the surface of deposited material to leave an underlying layer. In the latter case, the bits will effectively shape, and maintain an intermittent sliding contact with, a new proximate conveyor wall surface comprising adherent deposits. The new surface will substantially approximate the surface of the above substantially contiguous composite sweep in space, the surface being separated from the flights by a distance substantially equal to the (preferably substantially uniform) bit height distance H.

Choice of the optimal dimensions and spacing for bits 23 is based on consideration of parameters including (but not limited to) bit hardness and resistance to fracture, screw diameter and preferred rotational speed, flight size and strength, consistency of any adherent deposits and the preferred rotational torque for the screw shaft. Given a set of parameters including one or more of those above, a preferred range for bit effective longitudinal bit sweeps may be specified. For example, an increase in bit sweep will reduce the number of bits needed for scraping a given longitudinal length of conveyor wall, but wider bits exert greater individual forces on a flight to which they are firmly coupled. Further, frictional force for a single bit on the conveyor wall may significantly differ from the sum of frictional forces for two or more bits having a contiguous composite sweep length substantially equal to the effective longitudinal bit sweep of the single bit 23. Hence, preferred bit width W, as well as optimal bit height H are preferably determined empirically.

Bits 23 may be firmly coupled to flight(s) 14 so as to be substantially coplanar with an adjacent portion of flight 14 as shown in FIG. 3A. Non-coplanar bits (illustrated as 23' in FIG. 3A) may also be employed, but consideration must be given to possible interference with the intended function of any breaker devices used in conjunction with non-coplanar bits 23'.

Methods of providing thermal protection of screw shaft bearing areas in certain embodiments of the present invention comprise provision for active or passive circulation of cooling fluid within double-walled portions of the respective screw shaft bearing areas. In preferred embodiments, each screw shaft bearing area may comprise a plurality of cooling fluid inlets and a plurality of cooling fluid outlets through which cooling fluid (e.g., air, water or fuel) is directed to provide one or more heat sinks for absorbing thermal energy before said energy reaches the bearing assemblies and/or rotary drive components.

Because such absorbed heat is carried away by the cooling fluid, rotary drive components (e.g., bearing assemblies, gears, chains and motors) located within bearing areas would be exposed to a reduced flow of thermal energy from the heated portion of the screw shaft. If the cooling fluid is air and one or more fuel burners act as a heat source, at least a portion of the air which is preheated by passage through double-walled portions of which the bearing areas are comprised may thereafter be directed to the burner(s) to increase the thermal efficiency of the burner(s). Thus, double-walled portions of a screw shaft 1,1' may comprise an air preheater. If desired for cold weather operation, double-walled portions of a screw shaft 1,1' proximate one or both bearing areas may additionally or alternatively comprise a fuel preheater wherein at least a portion of the fuel supply for a desorber burner may be preheated (again, to increase the thermal efficiency of the burner(s)). Certain embodiments of the invention may therefore Comprise either an air preheater or a fuel preheater or both.

Referring to FIGS. 1A, 1B, 1C, 2, and 4F, a double-wall screw shaft 1 of the present invention is seen to comprise a screw shaft wall 2, having a longitudinal length L, an inner surface 4, an outer surface 3, a first end 8, and a second end 19, said screw shaft wall 2 being substantially symmetrical about a substantially centered longitudinal rotational axis extending through said screw shaft wall first and second ends, 8,19 respectively. A double-wall screw shaft 1 also comprises an internal chamber wall 5, having an inner surface 6, an outer surface 7, a first end 27, and a second end 28, said internal chamber wall 5 being substantially symmetrical about a substantially centered longitudinal rotational axis extending through said internal chamber wall first and second ends 27,28 respectively, said internal chamber wall rotational axis being substantially coaxial with said screw shaft wall rotational axis, at least a portion of said internal chamber wall outer surface 7 being contained within, spaced apart from and overlapped by at least a portion of said screw shaft wall inner surface 4 to form a double wall.

A double-wall screw shaft 1 also comprises a gas guide 10, disposed between and firmly coupling said screw shaft wall inner surface 4 and said internal chamber wall outer surface 7, for coupling and spacing apart at least a portion of said internal chamber wall 5 and said screw shaft wall 2 and for guiding heating gas along a substantially predetermined path between said internal chamber wall and said screw shaft wall to facilitate heat transfer from heating gas to said screw shaft wall 2.

A double-wall screw shaft 1 further comprises at least one substantially helical external flight 14, having a base edge 15, an outer edge 16, and at least one local external flight pitch Y, said base edge 15 being firmly coupled to said screw shaft wall outer surface 3 and extending over an effective longitudinal flight length for transporting semisolid material relative to said screw shaft wall outer surface 3 during screw shaft 1 rotation. A first diverter plate 20,20' is firmly coupled to said internal chamber wall 5 proximate said internal chamber wall first end 27 substantially transverse to said internal chamber rotational axis for directing heating gas to said gas guide 10. A first screw shaft bearing area 11 is firmly coupled to said screw shaft wall 2 adjacent said screw shaft wall first end 8, and a second screw shaft bearing area 12 is firmly coupled to said screw shaft wall 2 adjacent said screw shaft wall second end 19. Finally, at least one rotary drive means 62 is firmly coupled to said screw shaft wall 2.

The double-wall screw shaft described above may additionally comprise a second diverter plate 50,50' firmly coupled to said internal chamber wall 5 proximate said internal chamber wall second end 28 and substantially transverse to said internal chamber rotational axis for facilitating, in conjunction with said first diverter plate 20,20', smooth flow of heating gas through the screw shaft 1. In certain embodiments, a rotary drive means 62 is coupled to said screw shaft wall proximate said screw shaft first end. The at least one substantially helical external flight 14 may comprise a single substantially helical external flight having a single substantially constant local external flight pitch Y, but the external flight may also have a single substantially continuously varying local external flight pitch or at least two discrete local external flight pitches.

In certain preferred embodiments of double-walled screw shaft 1 the at least one substantially helical external flight outer edge 16 comprises a plurality of hardened bits 23,23', each said hardened bit 23,23' having an effective longitudinal bit sweep and a bit height. Each of the plurality of hardened bits 23,23' is preferably substantially evenly spaced along said at least one substantially helical external flight outer edge 16, and said plurality of longitudinal bit sweeps combine to form a substantially contiguous composite sweep substantially equal in length to said effective longitudinal flight length.

A preferred embodiment of double-walled screw shaft 1 may have a screw shaft wall 2 about six feet in diameter with a length about twenty-four feet. In this case, the at least one substantially helical external flight 14 has an outer edge 16 extending above said screw shaft wall outer surface 3 a distance X between about one and about six inches, preferably about two and five-eights inches. Firmly coupled to outer edge 16 is a plurality of evenly spaced bits 23,23' wherein each said bit height is between about one-quarter and about two inches, preferably about one inch. The at least one substantially helical external flight 14 has a local external flight pitch of about four inches for a portion extending about four feet from said screw shaft wall first end, a local external flight pitch of about five inches for a portion extending between about four feet and about twelve feet from said screw shaft wall first end, and a local external flight pitch of about six inches for a portion extending between about twelve feet and about twenty-four feet from said screw shaft wall first end.

The gas guide 10 in preferred embodiments of double-walled screw shaft 1 comprises at least one (and preferably eight) substantially helical flights 39, each said at least one gas guide flight 39 having at least one local gas guide flight pitch (preferably of about forty-two and one-half inches).

A single-wall screw shaft 1' comprises a screw shaft wall 2, having an inner surface 4, an outer surface 3, a first end 8, and a second end 19, said screw shaft wall 2 being substantially symmetrical about a substantially centered longitudinal rotational axis extending through said screw shaft wall first and second ends. The single-wall screw shaft 1' also comprises a gas guide 10', firmly coupled to said screw shaft wall inner surface 4 for guiding heating gas along a substantially predetermined path comprising at least a portion of said screw shaft wall inner surface 4 to facilitate heat transfer from heating gas to said screw shaft wall 2.

A single-wall screw shaft 1' further comprises at least one substantially helical external flight 14, having a base edge 15, an outer edge 16, and at least one local external flight pitch Y, said base edge 15 being firmly coupled to said screw shaft wall outer surface 2 and extending over an effective longitudinal flight length for transporting semisolid material relative to said screw shaft wall outer surface 3 during screw shaft 1' rotation. The screw shaft 1' also comprises a first screw shaft bearing area 11 firmly coupled to said screw shaft wall 2 adjacent said screw shaft wall first end 8, and a second screw shaft bearing area 12 firmly coupled to said screw shaft wall 2 adjacent said screw shaft wall second end 19, with at least one rotary drive means 62 firmly coupled to said screw shaft wall 2 (preferably proximate said screw shaft first end 8).

As in the case of a double-wall screw shaft 1, a single-wall screw shaft 1' preferably comprises a single substantially helical external flight 14 which may have a single substantially constant local external flight pitch, a substantially continuously varying local external flight pitch, or at least two discrete local external flight pitches. External flight 14 preferably has an outer edge 16 extending above said screw shaft wall outer surface 3 a distance between about one and about six inches in certain preferred embodiments with a plurality of hardened bits as on external flight(s) 14 of a double-wall screw shaft 1.

Analogously to the gas guide 10 of a double-wall screw shaft 1, the gas guide 10' of a single-wall screw shaft 1' comprises at least one substantially helical flight, said at least one gas guide flight having at least one local gas guide flight pitch (preferably a single local gas guide flight pitch).

A screw conveyor 99,99',99" of the present invention comprises a framework 26 and at least one bearing assembly pair, a beating assembly pair comprising a first screw shaft bearing assembly 61 and a second screw shaft beating assembly 61 spaced apart, said bearing assembly pair being adjustably coupled to said framework 26. The screw conveyor 99,99',99" also comprises at least one single-wall and/or double-wall screw shaft 1,1' respectively as described above, each said at least one screw shaft 1,1' being supported within and rotatingly coupled to said framework 26 by a bearing assembly pair, wherein said first screw shaft bearing assembly 60 acts at said first screw shaft bearing area 11 and said second screw shaft bearing assembly 61 acts at said second screw shaft bearing area 12.

A screw conveyor 99,99',99" of the present invention also comprises a conveyor wall 34, said conveyor wall 34 substantially enclosing said at least one screw shaft 1,1' except for portions of said first and second screw shaft beating areas 11,12 respectively, said conveyor wall 34 having an inner surface 49 and an outer surface 48, at least a portion of said conveyor wall inner surface 49 being spaced an effective distance from at least a portion of said at least one substantially helical external flight 14 on each of said at least one screw shafts 1,1' to facilitate conveyance of semisolid material relative to said conveyor wall 34 and said screw shaft 1,1' during rotation of said screw shaft 1,1' with respect to said conveyor wall 34.

Finally a screw conveyor 99,99',99" of the present invention also comprises at least one rotary power source 13 adjustably coupled to said framework 26 and drivingly coupled to each said at least one rotary drive means 62 for rotating each said at least one screw shaft 1,1' with respect to said framework 26.

Preferred embodiments of a screw conveyor 99" may further comprise at least one fuel burner 29', each said fuel burner being adjustably coupled substantially centrally within said first bearing area 11 of one of said at least one screw shaft 1 to produce high-temperature heating gas directed to said first (perforated) diverter plate 20'.

Preferred embodiments of a screw conveyor 99 may further comprise at least one diluting fuel burner 29, each said fuel burner being adjustably coupled substantially centrally within said first bearing area 11 of one of said at least one screw shaft 1 to produce controlled-temperature heating gas directed to said first (non-perforated) diverter plate 20.

A screw conveyor 99,99',99" of the present invention may further comprise at least one breaker device 42,43,70 coupled to said framework 26 and intermittently slidingly contacting at least a portion of said substantially helical external flight 14 and said screw shaft wall outer surface 3 of each said at least one screw shaft 1,1' to facilitate removal of compacted semisolid material from said external flight 14 and said screw shaft wall outer surface 3. The at least one breaker device 70 is slidingly coupled to said framework 26, breaker device 43 is springingly coupled to said framework 26, and breaker device 42 is slidingly and springingly coupled to said framework 26. Breaker device 42 may additionally comprise a (hardened) ball tip 35 to limit contact with external flight 14 and/or screw shaft wall outer surface 3.

Operation of a desorber 99' of the present invention may incorporate a method of limiting the temperature of heating gas entering desorber 99 to a maximum temperature, the method comprising estimating the temperature of the heating gas entering the desorber 99 to obtain a first temperature, and diluting the heating gas entering the desorber 99 with sufficient cooling fluid at a second temperature to form a mixture of heating gas and cooling fluid at a third temperature, said second temperature being less than said first temperature and the maximum temperature, and said third temperature being substantially equal to the maximum temperature. This method preferably includes use of air as a cooling fluid.

What is claimed is:

1. A double-wall screw shaft, comprising a screw shaft wall, having a longitudinal length, an inner surface, an outer surface, a first end, and a second end, said screw shaft wall being substantially symmetrical about a substantially centered longitudinal rotational axis extending through said screw shaft wall first and second ends;

an internal chamber wall, having an inner surface, an outer surface, a first end, and a second end, said internal chamber wall being substantially symmetrical about a substantially centered longitudinal rotational axis extending through said internal chamber wall first and second ends, said internal chamber wall rotational axis being substantially coaxial with said screw shaft wall rotational axis, at least a portion of said internal chamber wall outer surface being contained within, spaced apart from and overlapped by at least a portion of said screw shaft wall inner surface to form a double wall;

a gas guide, disposed between and firmly coupling said screw shaft wall inner surface and said internal chamber wall outer surface, for coupling and spacing apart at least a portion of said internal chamber wall and said screw shaft wall and for guiding heating gas along a substantially predetermined path between said internal chamber wall and said screw shaft wall to facilitate heat transfer from heating gas to said screw shaft wall;

at least one substantially helical external flight, having a base edge, an outer edge, and at least one local external flight pitch, said base edge being firmly coupled to said screw shaft wall outer surface and extending over an effective longitudinal flight length for transporting semisolid material relative to said screw shaft wall outer surface during screw shaft rotation;

a first diverter plate firmly coupled to said internal chamber wall proximate said internal chamber wall first end substantially transverse to said internal chamber rotational axis for directing heating gas to said gas guide;

a first screw shaft bearing area firmly coupled to said screw shaft wall adjacent said screw shaft wall first end;

a second screw shaft bearing area firmly coupled to said screw shaft wall adjacent said screw shaft wall second end; and at least one rotary drive means firmly coupled to said screw shaft wall.

2. The screw shaft of claim 1, additionally comprising a second diverter plate firmly coupled to said internal chamber wall proximate said internal chamber wall second end and substantially transverse to said internal chamber rotational axis for facilitating, in conjunction with said first diverter plate, smooth flow of heating gas through the screw shaft.

3. The screw shaft of claim 1, wherein a rotary drive means is coupled to said screw shaft wall proximate said screw shaft first end.

4. The screw shaft of claim 1, wherein said at least one substantially helical external flight comprises a single substantially helical external flight.

5. The screw shaft of claim 4, wherein said single substantially helical external flight has a single substantially constant local external flight pitch.

6. The screw shaft of claim 4, wherein said single substantially helical external flight has a single substantially continuously varying local external flight pitch.

7. The screw shaft of claim 4, wherein said single substantially helical external flight has at least two discrete local external flight pitches.

8. The screw shaft of claim 1, wherein said internal chamber wall and said screw shaft wall each have a substantially right circular cylindrical shape.

9. The screw shaft of claim 2, further comprising cooling fluid inlet means firmly coupled to said second diverter plate for introducing cooling fluid into the screw shaft, wherein said first and second diverter plates each comprise at least one perforation.

10. The screw shaft of claim 1, wherein said first diverter plate comprises a plurality of perforations arranged substantially circularly and substantially symmetrically about said screw shaft wall rotational axis.

11. The screw shaft of claim 1, wherein said screw shaft wall is about six feet in diameter.

12. The screw shaft of claim 11, wherein said screw shaft wall length is about twenty-four feet.

13. The screw shaft of claim 12, wherein said at least one substantially helical external flight has an outer edge extending above said screw shaft wall outer surface a distance between about one and about six inches.

14. The screw shaft of claim 13, wherein said external flight outer edge extends above said screw shaft wall outer surface a distance of about two and five-eights inches.

15. The screw shaft of claim 1, wherein said at least one substantially helical external flight outer edge comprises a plurality of hardened bits, each said hardened bit having an effective longitudinal bit sweep and a bit height.

16. The screw shaft of claim 15, wherein said plurality of hardened bits is substantially evenly spaced along said at least one substantially helical external flight outer edge, and wherein said plurality of longitudinal bit sweeps combine to form a substantially contiguous composite sweep substantially equal in length to said effective longitudinal flight length.

17. The screw shaft of claim 16, wherein each said bit height is between about one-quarter and about two inches.

18. The screw shaft of claim 17, wherein each said bit height is about one inch.

19. The screw shaft of claim 18, wherein said at least one substantially helical external flight has a local external flight pitch of about four inches for a portion extending about four feet from said screw shaft wall first end, a local external flight pitch of about five inches for a portion extending between about four feet and about twelve feet from said screw shaft wall first end, and a local external flight pitch of about six inches for a portion extending between about twelve feet and about twenty-four feet from said screw shaft wall first end.

20. The screw shaft of claim 1, wherein said gas guide comprises at least one substantially helical flight, each said at least one gas guide flight having at least one local gas guide flight pitch.

21. The screw shaft of claim 20, wherein said gas guide comprises eight substantially helical flights.

22. The screw shaft of claim 21, wherein each said substantially helical gas guide flight has a single local gas guide flight pitch of about forty-two and one-half inches.

23. A screw conveyor, comprising a framework;

at least one bearing assembly pair, a bearing assembly pair comprising a first screw shaft bearing assembly and a second screw shaft bearing assembly spaced apart, said bearing assembly pair being adjustably coupled to said framework;

at least one screw shaft according to claim 1, each said at least one screw shaft being supported within and rotatingly coupled to said framework by a bearing assembly pair, wherein said first screw shaft bearing assembly acts at said first screw shaft bearing area and said second screw shaft bearing assembly acts at said second screw shaft bearing area;

a conveyor wall, said conveyor wall substantially enclosing said at least one screw shaft except for portions of said first and second screw shaft bearing areas, said conveyor wall having an inner surface and an outer surface, at least a portion of said conveyor wall inner surface being spaced an effective distance from at least a portion of said at least one substantially helical external flight on each of said at least one screw shafts to facilitate conveyance of semisolid material relative to said conveyor wall and said screw shaft during rotation of said screw shaft with respect to said conveyor wall; and at least one rotary power source adjustably coupled to said framework and drivingly coupled to each said at least one rotary drive means for rotating each said at least one screw shaft with respect to said framework.

24. A screw conveyor, comprising a framework;

at least one bearing assembly pair, a bearing assembly pair comprising a first screw shaft bearing assembly and a second screw shaft bearing assembly spaced apart, said bearing assembly pair being adjustably coupled to said framework;

at least one screw shaft according to claim 9, each said at least one screw shaft being supported within and rotatingly coupled to said framework by a bearing assembly pair, wherein said first screw shaft bearing assembly acts at said first screw shaft bearing area and said second screw shaft bearing assembly acts at said second screw shaft beating area;

a conveyor wall, said conveyor wall substantially enclosing said at least one screw shaft except for portions of said first and second screw shaft bearing areas, said conveyor wall having an inner surface and an outer surface, at least a portion of said conveyor wall inner surface being spaced an effective distance from at least a portion of said at least one substantially helical external flight on each of said at least one screw shafts to facilitate conveyance of semisolid material relative to said conveyor wall and said screw shaft during rotation of said screw shaft with respect to said conveyor wall; and at least one rotary power source adjustably coupled to said framework and drivingly coupled to each said at least one rotary drive means for rotating each said at least one screw shaft with respect to said framework.

25. The screw conveyor of claim 24, further comprising at least one fuel burner, each said fuel burner being adjustably coupled substantially centrally within said first bearing area of one of said at least one screw shaft to produce high-temperature heating gas directed to said first diverter plate.

26. The screw conveyor of claim 23 wherein said at least one substantially helical external flight has at least one discrete external flight pitch.

27. The screw conveyor of claim 23 wherein each said gas guide comprises at least one substantially helical flight, each said at least one gas guide flight having at least one local gas guide flight pitch.

28. The screw conveyor of claim 27 wherein each said gas guide comprises eight substantially helical flights.

29. The screw conveyor of claim 28 wherein each said substantially helical gas guide flight has a single local gas guide flight pitch.

30. The screw conveyor of claim 23 wherein each of said first and second screw shaft bearing areas comprise a double-walled cylindrical portion.

31. The screw conveyor of claim 23 further comprising at least one breaker device coupled to said framework and intermittently slidingly contacting at least a portion of said substantially helical external flight and said screw shaft wall outer surface of each said at least one screw shaft to facilitate removal of compacted semisolid material from said external flight and said screw shaft wall outer surface.

32. The screw conveyor of claim 31 wherein at least one of said at least one breaker device is slidingly coupled to said framework.

33. The screw conveyor of claim 31 wherein at least one of said at least one breaker device is springingly coupled to said framework.

34. The screw conveyor of claim 31 wherein at least one of said at least one breaker device is slidingly and springingly coupled to said framework.

35. The screw conveyor of claim 34 wherein at least one of said at least one breaker device additionally comprises a ball tip.

* * * * *